US007793439B2

(12) United States Patent
Chartrand et al.

(10) Patent No.: US 7,793,439 B2
(45) Date of Patent: Sep. 14, 2010

(54) SNOWSHOE APPARATUS

(75) Inventors: Daniel Chartrand, Deux Montagnes (CA); Teddy D. Palomaki, Park City, UT (US); Gregory J. Easton, Park City, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 742 days.

(21) Appl. No.: 11/741,531

(22) Filed: Apr. 27, 2007

(65) Prior Publication Data

US 2008/0263902 A1 Oct. 30, 2008

(51) Int. Cl.
*A43B 5/04* (2006.01)

(52) U.S. Cl. ..... 36/124; 36/125

(58) Field of Classification Search ..... 36/122–125
See application file for complete search history.

(56) References Cited

U.S. PATENT DOCUMENTS

| | | | | | |
|---|---|---|---|---|---|
| 4,161,071 | A | | 7/1979 | Maul | |
| 4,228,601 | A | * | 10/1980 | Lawton et al. | 36/124 |
| 4,348,823 | A | | 9/1982 | Knapp et al. | |
| 4,351,121 | A | | 9/1982 | Wallace | |
| 4,720,927 | A | | 1/1988 | Abegg | |
| 4,720,928 | A | * | 1/1988 | Faber et al. | 36/122 |
| 5,253,437 | A | | 10/1993 | Klebahn et al. | |
| 5,440,827 | A | | 8/1995 | Klebahn et al. | |
| 5,493,794 | A | | 2/1996 | McKenzie et al. | |
| 5,517,772 | A | * | 5/1996 | Anderson | 36/122 |
| 5,542,197 | A | | 8/1996 | Vincent | |
| 5,687,491 | A | | 11/1997 | Klebahn | |
| 5,718,068 | A | | 2/1998 | Sawyer et al. | |
| 5,787,612 | A | | 8/1998 | Mahoney et al. | |
| 5,918,387 | A | | 7/1999 | Emerson | |
| 5,918,388 | A | | 7/1999 | Emerson et al. | |
| 5,946,829 | A | | 9/1999 | Quellais et al. | |
| 6,003,249 | A | | 12/1999 | Watson | |
| 6,006,453 | A | * | 12/1999 | Klebahn et al. | 36/123 |
| 6,112,436 | A | | 9/2000 | Quellais | |
| 6,185,846 | B1 | * | 2/2001 | Neidhardt, Jr. | 36/124 |
| 6,363,628 | B1 | | 4/2002 | Mahon et al. | |
| 6,367,173 | B2 | * | 4/2002 | Lancon | 36/122 |
| 6,694,646 | B2 | * | 2/2004 | Messmer et al. | 36/122 |
| 6,725,576 | B2 | | 4/2004 | Emerson et al. | |
| 6,814,360 | B2 | | 11/2004 | Kiniry et al. | |
| 6,898,874 | B2 | | 5/2005 | Emerson et al. | |
| 7,509,757 | B2 | * | 3/2009 | Monsees et al. | 36/122 |
| 7,661,207 | B2 | * | 2/2010 | Monsees et al. | 36/122 |
| 2002/0083624 | A1 | * | 7/2002 | Lansel | 36/122 |
| 2008/0141564 | A1 | * | 6/2008 | Matthews et al. | 36/124 |

* cited by examiner

*Primary Examiner*—Ted Kavanaugh
(74) *Attorney, Agent, or Firm*—Holland & Hart

(57) ABSTRACT

A snowshoe apparatus having a frame assembly, a pivot assembly pivotally attached to the frame assembly, and a binding assembly pivotally attached to the pivot assembly is disclosed. The snowshoe apparatus may also include first and second crampons pivotally attached to the frame assembly, with the first crampon configured to pivot relative to the frame assembly substantially independent of the second crampon. In addition, at least one of the first crampon and the second crampon may be laterally movable relative to the frame assembly. The snowshoe apparatus may also comprise a resilient heel support assembly coupled to the frame assembly. A corresponding method of assembly is also disclosed.

26 Claims, 25 Drawing Sheets

SNOWSHOE APPARATUS

FIELD OF THE INVENTION

The present invention relates generally to the field of snowshoes and snowshoe apparatuses.

BACKGROUND OF THE INVENTION

Over the years, various snowshoes and snowshoe apparatuses have been developed to aid outdoor enthusiasts traverse snowy terrain. Conventional snowshoes typically comprise a frame, a deck affixed to the frame, and a binding assembly for coupling a snowshoer's footwear to the snowshoe. A cleat or crampon is also typically pivotally attached to the frame. When traversing particularly uneven terrain, the wearer of the snowshoe may dig the cleat or crampon into the terrain beneath the snowshoe to increase traction and prevent slippage.

SUMMARY OF THE INVENTION

According to at least one embodiment, a snowshoe apparatus may comprise a frame assembly, a pivot assembly pivotally attached to the frame assembly, and a binding assembly pivotally attached to the pivot assembly. In certain embodiments, the pivot assembly may pivot relative to the frame assembly and the binding assembly may pivot about at least a portion of the pivot assembly. In addition, the pivot assembly may comprise a first pivot arm pivotally attached to the frame assembly, a second pivot arm pivotally attached to the frame assembly, and a pivot rod coupling the first pivot arm to the second pivot arm. In at least one embodiment, the pivot rod may comprise a rigid material.

In an additional embodiment, the binding assembly may comprise first and second crampons pivotally attached to the pivot assembly and first and second binding portions pivotally attached to the pivot assembly. In many embodiments, the first crampon and the first binding portion may pivot about the pivot assembly substantially independent of the second crampon and the second binding portion. In addition, at least one of the first crampon and the second crampon may be laterally movable relative to the frame assembly.

In at least one embodiment, the frame assembly may comprise a first rail having a first end and a second end, a second rail having a first end and a second end, a first flexible connecting structure coupling the first end of the first rail to the first end of the second rail, and a second flexible connecting structure coupling the second end of the first rail to the second end of the second rail. In addition, an outer diameter of the first rail may differ from an outer diameter of the second rail. The snowshoe apparatus may also comprise a heel support assembly coupled to the frame assembly, with the heel support assembly comprising a top surface, a bottom surface, and at least one flexible, resilient material. In certain embodiments, at least a portion of the bottom surface of the heel support assembly may be substantially concave in shape. In addition, at least one traction structure may be affixed to at least a portion of the heel support assembly.

In at least one embodiment, the snowshoe apparatus may also comprise a deck affixed to at least a portion of the frame assembly, a first semi-rigid deck reinforcement member coupling the deck to a front portion of the frame assembly and a second semi-rigid deck reinforcement member coupling the deck to a rear portion of the frame assembly. In addition, the binding assembly may comprise a medial binding portion having at least one receiving structure, a lateral binding portion, a heel binding portion having a first end attached to the lateral binding portion and a second end disposed within, and movable relative to, the receiving structure of the medial binding portion, a first fastening structure provided on the lateral binding portion, and a strap having a first end attached to the medial binding portion and a second end threaded through the fastening structure and attached to the second end of the heel binding portion. A second fastening structure may also be provided on the lateral binding portion and a handle portion may be provided on the strap and disposed between the first fastening structure and the second fastening structure.

In an additional embodiment, a snowshoe apparatus may comprise a frame assembly, a first crampon pivotally attached to the frame assembly, and a second crampon pivotally attached to the frame assembly. In at least one embodiment, the first crampon may pivot relative to the frame assembly substantially independent of the second crampon. The snowshoe apparatus may also comprise a first pivot arm pivotally attached to the frame assembly, a second pivot arm pivotally attached to the frame assembly, and a pivot rod coupling the first pivot arm to the second pivot arm, with the first crampon and the second crampon pivotally attached to the pivot rod. In certain embodiments, at least one of the first crampon and the second crampon may be laterally movable relative to the frame assembly. In addition, the binding assembly may comprise a first binding portion attached to the first crampon and a second binding portion attached to the second crampon. In at least one embodiment, the first crampon and the first binding portion may pivot relative to the frame assembly substantially independent of the second crampon and the second binding portion.

In an additional embodiment, a snowshoe may comprise a frame assembly comprising a first rail having a first end and a second end, a second rail having a first end and a second end, and a first flexible connecting structure coupling the first end of the first rail to the first end of the second rail to form a front portion of the frame assembly. The snowshoe may also comprise a second flexible connecting structure coupling the second end of the first rail to the second end of the second rail to form a rear portion of the frame assembly. In at least one embodiment, an outer diameter of the first rail may differ from an outer diameter of the second rail.

In an additional embodiment, a snowshoe may comprise a frame assembly and a heel support assembly coupled to the frame assembly. In many embodiments, the heel support assembly may comprise a top surface, a bottom surface, and at least one flexible, resilient material. In addition, at least a portion of the bottom surface of the heel support assembly may be substantially concave in shape. At least one traction structure may also be affixed to at least a portion of the heel support assembly, such as the substantially concave portion of the bottom surface of the heel support assembly.

In an additional embodiment, a snowshoe may comprise a frame assembly, a first crampon coupled to the frame assembly, and a second crampon coupled to the frame assembly but detached from the first crampon. In at least one embodiment, at least one of the first crampon and the second crampon may be laterally movable relative to the frame assembly. In addition, the first crampon and the second crampon may be pivotally attached to the frame assembly. The first crampon may also be laterally movable relative to the frame assembly independent of the second crampon and the second crampon may be laterally movable relative to the frame assembly independent of the first crampon.

In an additional embodiment, a snowshoe apparatus may comprise a frame assembly comprising a first rail having a first end, a second end, an inner diameter, and an outer diameter and a second rail having a first end, a second end, an inner diameter, and an outer diameter that differs from the outer diameter of the first rail.

In an additional embodiment, a snowshoe apparatus may comprise a frame assembly and a binding assembly coupled to the frame assembly. In at least one embodiment, the binding assembly may comprise a medial binding portion having at least one receiving structure, a lateral binding portion, a heel binding portion having a first end attached to the lateral binding portion and a second end disposed within, and movable relative to, the receiving structure of the medial binding portion, a first fastening structure provided on the lateral binding portion, and a strap having a first end attached to the medial binding portion and a second end threaded through the fastening structure on the lateral binding portion and attached to the second end of the heel binding portion. The binding assembly may also further comprise a second fastening structure provided on the lateral binding portion and a handle portion provided on the strap and disposed between the first fastening structure and the second fastening structure. In certain embodiments, the heel portion and the lateral portion may be integrally formed in a one-piece construction.

In an additional embodiment, a method of assembling a snowshoe apparatus may comprise providing a frame assembly, pivotally attaching a pivot assembly to the frame assembly, and pivotally attaching a binding assembly to the pivot assembly. In at least one embodiment, the pivot assembly may pivot relative to the frame assembly and the binding assembly may pivot about at least a portion of the pivot assembly.

Features from any of the above-mentioned embodiments may be used in combination with one another in accordance with the present invention. These and other embodiments, features and advantages will be more fully understood upon reading the following detailed description in conjunction with the accompanying drawings and claims.

BRIEF DESCRIPTION OF THE DRAWINGS

The accompanying drawings illustrate exemplary embodiments of the present invention and are a part of the specification. Together with the following description, the drawings demonstrate and explain the principles of the present invention.

Figure 1:
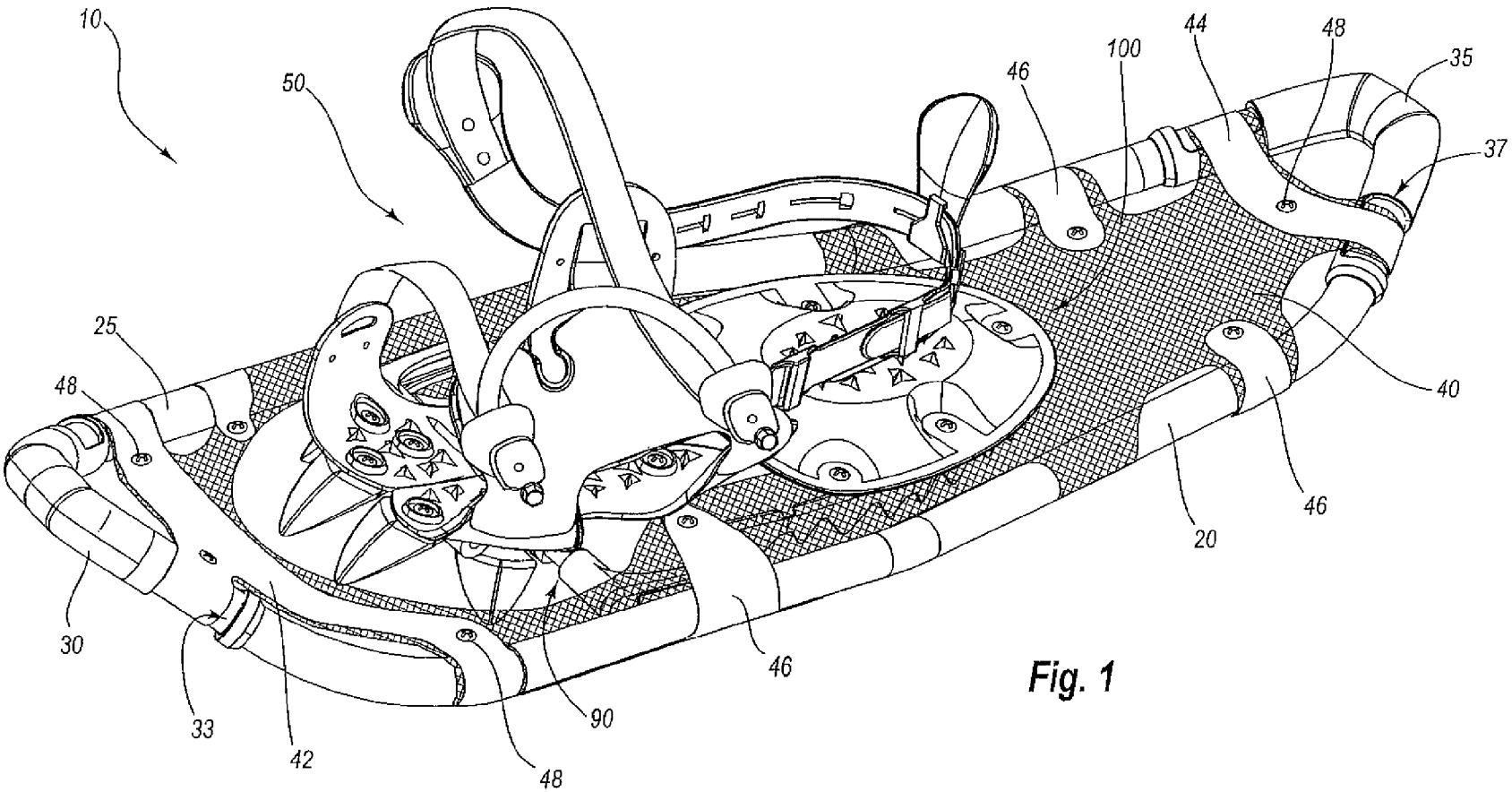
FIG. 1 is a perspective view of an exemplary snowshoe apparatus according at least one embodiment.

Throughout the drawings, identical reference characters and descriptions indicate similar, but not necessarily identical, elements. While the present invention is susceptible to various modifications and alternative forms, specific embodiments have been shown by way of example in the drawings and will be described in detail herein. However, one of skill in the art will understand that the present invention is not intended to be limited to the particular forms disclosed. Rather, the invention covers all modifications, equivalents and alternatives falling within the scope of the invention as defined by the appended claims.

DETAILED DESCRIPTION OF PREFERRED EMBODIMENTS

FIGS. 1-4 are assembled, exploded, bottom, and top views, respectively, of an exemplary snowshoe apparatus 10 according at least one embodiment. As illustrated in these figures, exemplary snowshoe apparatus 10 may comprise a frame assembly (comprising, in at least one embodiment, a first rail 20 and a second rail 25). The phrase "frame assembly," as used in the specification and claims, generally refers to any type or form of snowshoe frame or body. Examples of suitable frame assemblies include, without limitation, one-piece snowshoe bodies (such as one-piece molded snowshoe bodies formed of lightweight materials, such as composites) and multi-piece frame assemblies (formed, for example, of a variety of interconnecting parts and materials). In at least one embodiment, the frame assembly of exemplary snowshoe apparatus 10 may also comprise a decking material (such as deck 40, discussed in greater detail below) either integrally formed with or affixed to the frame assembly.

First and second rails 20 and 25 generally represent any type or form of snowshoe frame or rail and may be formed of any number or combination of materials, such as metal (e.g., aluminum or stainless steel), composite materials, plastic, wood, or any other suitable material. Rails 20 and 25 may also each be made of the same material or each may be made of a different material in any combination of the above-listed materials. For example, rail 20 may be made of carbon-fiber composite and rail 25 may be made of aluminum, or visa versa.

Rails 20 and 25 may also be formed in any number of shapes and sizes. Rails 20 and 25 may also each have different cross-sectional shapes and may each have different cross-sectional sizes. For example, as best seen in FIG. 2, first rail 20 may comprise a substantially longitudinally extending body having a first end 22 and a second end 24. Similarly, second rail 25 may comprise a substantially longitudinally extending body having a first end 26 and a second end 28. In at least one embodiment, and as illustrated in the perspective views of FIGS. 1-2, the first ends 22 and 26 and the second ends 24 and 28 of both first and second rails 20 and 25 may be bent upwards to minimize drag and provide increased ground clearance.

The inner and outer diameters and/or the general shape, size, and weight of rails 20 and 25 may also be varied as desired to achieve a frame assembly of varying shapes, sizes, and weights. For example, in certain embodiments, rails 20 and 25 may be shaped so as to form an asymmetrically shaped frame assembly adapted to be worn on a wearer's left or right foot. For example, when adapted for wear on a left foot (as is the case in FIG. 1), the upper and bottom portions of first rail 20 (i.e., those portions proximate first and second ends 22 and 24) may be tilted slightly rightward towards second rail 25. Conversely, when adapted for wear on a right foot, the upper and bottom portions of second rail 25 (i.e., those portions proximate first and second ends 26 and 28) may be tilted slightly leftward towards first rail 20. In at least one embodiment, this configuration may result in an asymmetric pair of snowshoes adapted for wear on either the left or right foot of a wearer.

Figure 3:
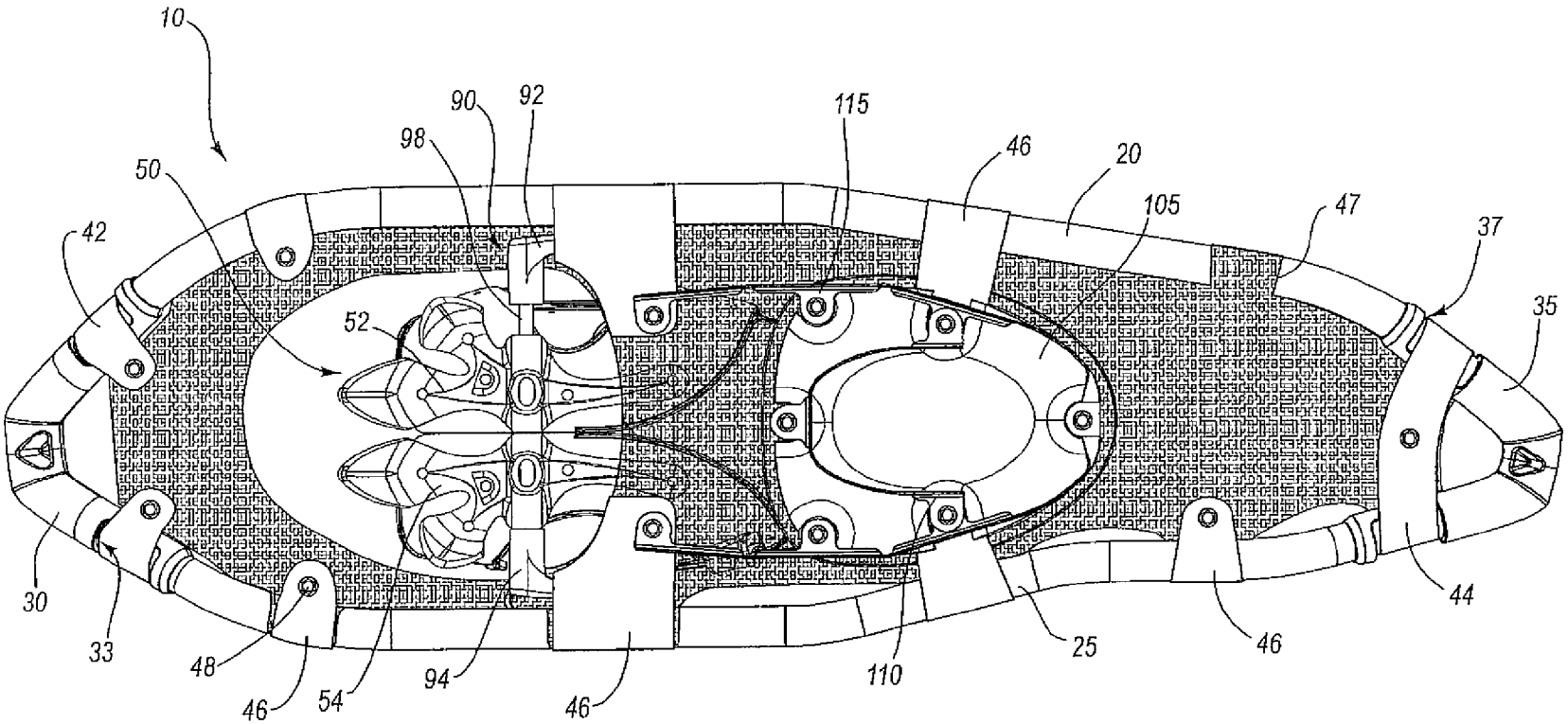
FIG. 3 is a bottom view of the exemplary snowshoe apparatus illustrated in FIG. 1.
Figure 4:
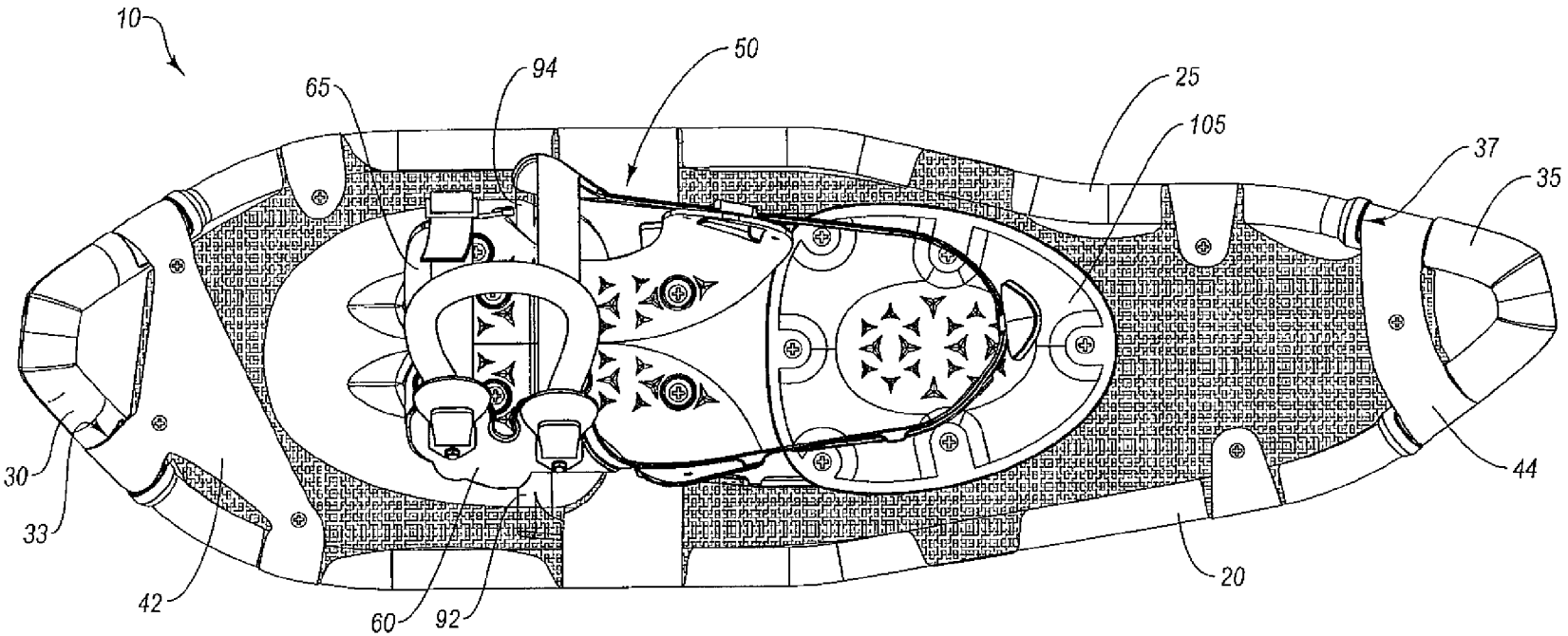
FIG. 4 is a top view of the exemplary snowshoe apparatus illustrated in FIG. 1.

In at least one embodiment, the frame assembly of exemplary snowshoe apparatus 10 may comprise a first connecting structure 30 for coupling the first end 22 of first rail 20 to the first end 26 of second rail 25. Similarly, in certain embodiments the exemplary frame assembly illustrated in FIG. 1 may also comprise a second connecting structure 35 for coupling the second end 24 of first rail 20 to the second end 28 of second rail 25. As with rails 20 and 25, connecting structures 30 and 35 may be formed in any number of shapes and sizes. For example, in at least one embodiment, and as best illustrated in FIGS. 3 and 4, first connecting structure 30 may be formed in a general "U" shape comprising a first end 32 and a second end 34. Similarly, second connecting structure 35 may be formed in a general "U" shape comprising a first end 36 and a second end 38.

Figure 2:
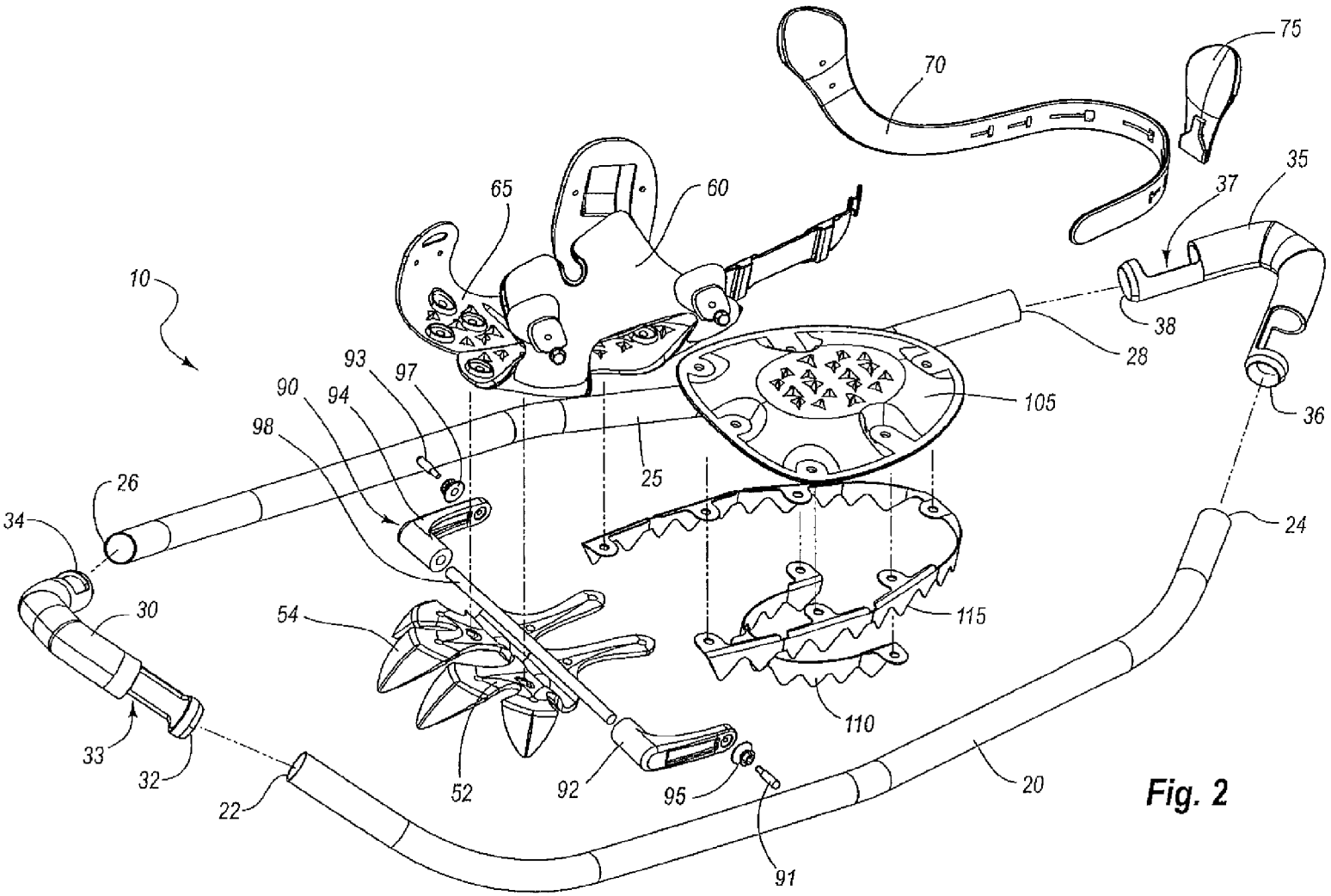
FIG. 2 is an exploded perspective view of the exemplary snowshoe apparatus illustrated in FIG. 1.

As seen in FIGS. 1 and 2, the first end 22 of first rail 20 and the first end 26 of second rail 25 may each have an outer diameter that is slightly less than an inner diameter of connecting structure 30 so that first ends 22 and 26 may be inserted into connecting structure 30 to couple rails 20 and 25 together to form a front portion of the frame assembly. Similarly, the second end 24 of first rail 20 and the second end 28 of second rail 25 may each have an outer diameter that is slightly less than an inner diameter of connecting structure 35 so that second ends 24 and 28 may be inserted into connecting structure 35 to couple rails 20 and 25 together to form a rear portion of the frame assembly.

Connecting structures 30 and 35 may be formed of any number or combination of materials. For example, in at least one embodiment, connecting structures 30 and 35 may comprise at least one flexible material, such as a natural or synthetic rubber, a thermoplastic elastomer, or the like. In certain embodiments, this flexible material may enable connecting structures 30 and 35 to flex and/or bend as a wearer's weight is distributed or shifted throughout the frame assembly of exemplary snowshoe 10. For example, because the terrain traversed by snowshoers is rarely flat or predictable, connecting structures 30 and 35 may bend or flex to compensate for variations in terrain to provide a more comfortable and natural walking experience for a wearer of exemplary snowshoe 10.

As illustrated in FIG. 1, exemplary snowshoe 10 may also comprise a deck 40 affixed to and covering at least a portion of the frame assembly. Deck 40, which generally represents any type or form of decking material, may be formed from any number or combination of materials. For example, deck 40 may be formed of nylon, plastic, natural or synthetic rubber (such as polychloroprene), polypropylene, or any other suitable material. Deck 40 may also be formed of a laminated structure comprising two or more materials. In addition, deck 40 may be formed in any number of shapes and sizes. For example, deck 40 may be formed in a mesh, weave-like, or solid pattern.

In at least one embodiment, a portion of deck 40 may be wrapped around and affixed to at least a portion of the frame assembly of exemplary snowshoe 10. For example, as illustrated in FIG. 1, various portions of deck 40 may be wrapped around and secured to portions of first rail 20, second rail 25, first connecting structure 30, and/or second connecting structure 35 using one or more fasteners 48. In addition, in certain embodiments, one or more deck reinforcement members 42, 44 and 46 may be used to reinforce and strengthen the attachment of deck 40 to the frame assembly of exemplary snowshoe 10. For example, as illustrated in FIG. 1, a front deck reinforcement member 42 may be affixed to a front portion of deck 40 and then wrapped around and secured to a front portion of the frame assembly using fasteners 48. Similarly, a rear deck reinforcement member 44 may be affixed to a rear portion of deck 40 and then wrapped around and secured to a rear portion of the frame assembly using fasteners 48. A plurality of additional deck reinforcement members 46 may also be affixed to various other portions of deck 40 using fasteners 48 to more securely attach these portions of deck 40 to the frame assembly.

In other embodiments, a deck reinforcement member 47 (FIG. 3) may be made of the same material from which deck 40 (FIG. 1) is made. Accordingly, the deck reinforcement member 47 may simply comprise an extension of deck material which is looped and secured back onto itself to form a passageway. Any suitable securing method may be used to secure the deck material back onto itself, including, without limitation, adhesives, mechanical fasteners, welding, or any other suitable fastener. Therefore, according to some embodiments, a plurality of deck reinforcement members in the form of loops, similar to the loop formed by reinforcement member 47 of FIG. 3, may be formed about the periphery of the main snowshoe deck. Such a plurality of loops may be formed prior to assembling the snowshoe frame. Furthermore, in some embodiments such loops may be made of a separate material, as opposed to the deck material, and secured by any above-discussed methods. In such embodiments, to assemble the snowshoe, the snowshoe frame members would need to be inserted through the loops in multiple pieces and secured in place thereafter. Using this assembly method, the only fastening required would be to secure connecting structures 30, 35 to the frame members. As those skilled in the art will understand, such a method of assembly could be readily employed in the field.

Deck reinforcement members 42, 44 and 46 may be formed in any number of shapes and sizes and of any number or combination of materials. For example, in certain embodiments, deck reinforcement members 42, 44, and 46 may comprise a rigid or semi-rigid material, such as plastic or metal. Deck reinforcement members 42, 44 and 46 may also be affixed to the frame assembly of exemplary snowshoe 10 in any number of ways. For example, in certain embodiments, portions of front deck reinforcement member 42 may be wrapped around rails 20 and 25 and positioned within one or more cutout portions 33 defined in first connecting structure 30. Similarly, portions of rear deck reinforcement member 44 may be wrapped around rails 20 and 25 and positioned within one or more cutout portions 37 defined in second connecting structure 35. In at least one embodiment, cutout portions 33 and 37 may help retain deck 40 and deck reinforcement members 42 and 44 in a desired position relative to the frame assembly of exemplary snowshoe 10.

Figure 5A:
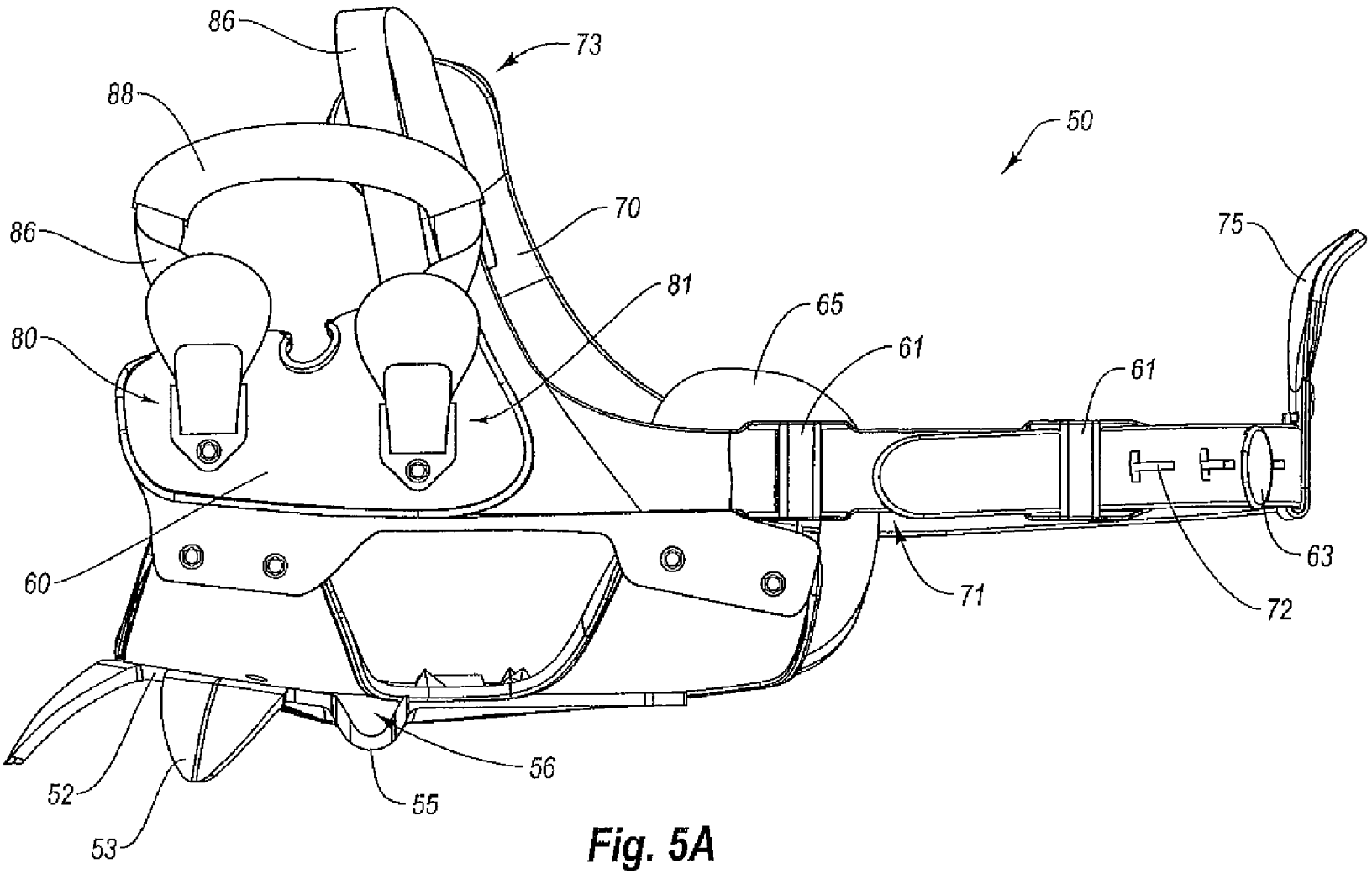
FIG. 5A is a side elevation view of an exemplary binding assembly according to at least one embodiment.
Figure 5B:
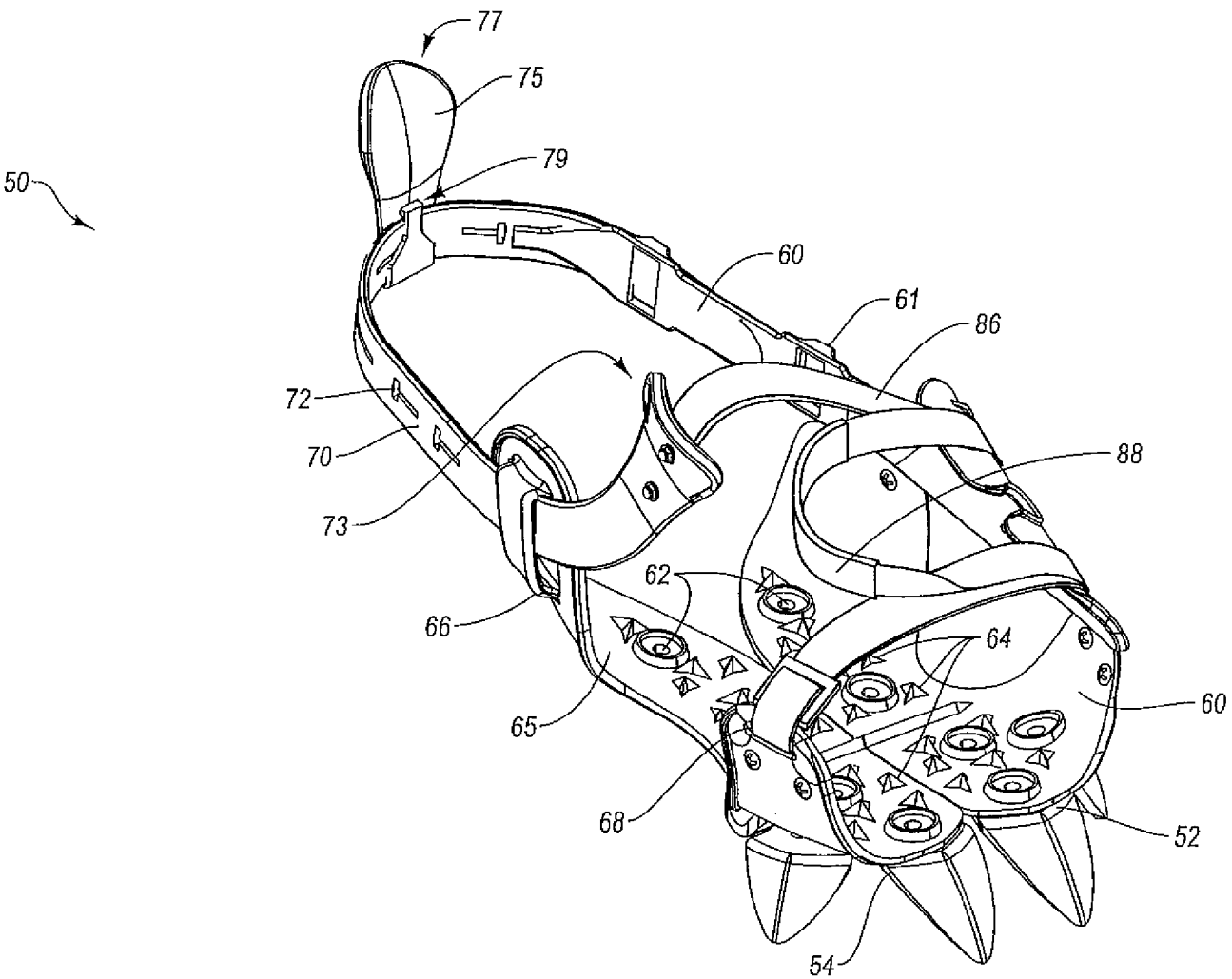
FIG. 5B is a perspective view of the exemplary binding assembly illustrated in FIG. 5A.
Figure 5C:
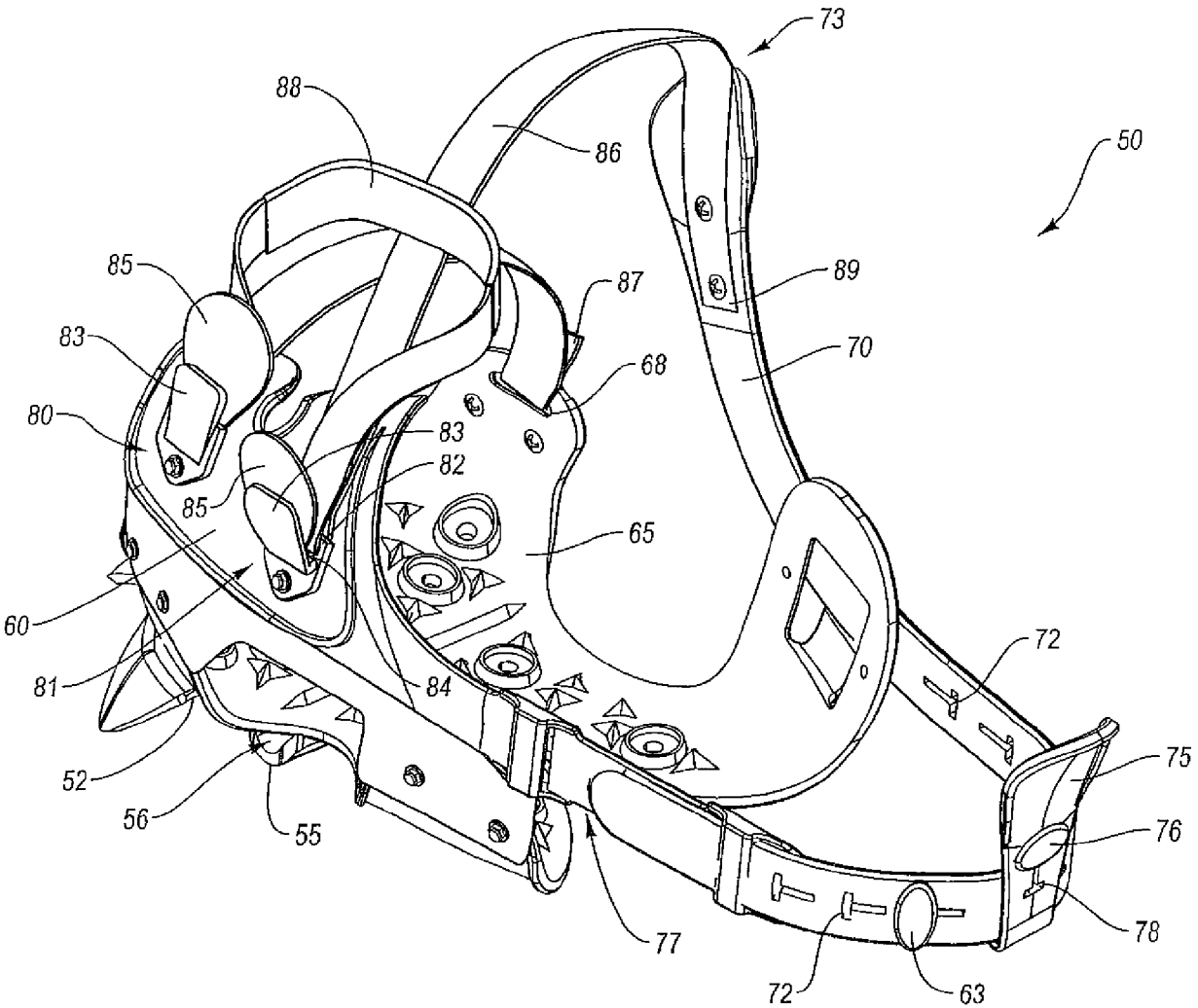
FIG. 5C is an additional perspective view of the exemplary binding assembly illustrated in FIG. 5A.

As illustrated in FIGS. 3-4, exemplary snowshoe 10 may also comprise a binding assembly 50 coupled to the frame assembly by a pivot assembly 90. FIGS. 5A-5C are side and perspective views of the exemplary binding assembly 50 illustrated in FIGS. 1-4. As seen in these figures (and as best seen in FIG. 5B), exemplary binding assembly 50 may comprise a first binding portion 60, a second binding portion 65, a third binding portion 70, a first crampon 52, and a second crampon 54. Binding portions 60, 65, and 70 may be formed in any number of shapes and sizes. For example, in embodiments where binding assembly is adapted to bind a wearer's left footwear to snowshoe 10, first binding portion 60 may be sized to surround a lateral portion of a wearer's footwear, second binding portion 65 may be sized to surround a medial portion of a wearer's footwear, and third binding portion 70 may be sized to surround a heel portion of a wearer's footwear. In addition, if desired, first binding portion 60, second binding portion 65, and/or third binding portion 70 may be integrally formed in a one-piece construction. Binding portions 60, 65, and 70 may also be formed of any number or combination of materials; including, for example, plastic, natural or synthetic rubber (such as polychloroprene), thermoplastic elastomers, nylon, or any other suitable material.

As illustrated in FIGS. 5A-5C, first binding portion 60 may comprise one or more receiving structures 61 sized to receive additional binding portions of binding assembly 50. For example, as illustrated in FIGS. 5A and 5C, a first end 71 of third binding portion 70 may be inserted into and passed through one or more receiving structures 61 provided on first binding portion 60. First binding portion 60 may also comprise a fastening structure 63 for removably affixing first binding portion 60 to additional binding portions of binding assembly 50. For example, as illustrated in FIGS. 5A and 5C, fastening structure 63 may be disposed and retained within a fastening aperture 72 defined in third binding portion 70 to removably affix first binding portion 60 to third binding portion 70. Fastening structure 63 generally represents any type or form of fastening structure capable of removably affixing a portion of first binding portion 60 to third binding portion 70; including, for example, snaps, buckles, and any other suitable fastening structure. Similarly, fastening aperture 72 may be defined through third binding portion 70 in any number of corresponding shapes and sizes.

As with first binding portion 60, and as illustrated in FIG. 5B, second binding portion 65 may comprise one or more receiving structures 66 sized to receive additional binding portions of binding assembly 50. For example, as illustrated in FIG. 5B, a second end 73 of third binding portion 70 may be inserted into and passed through receiving structure 66 of second binding portion 65. In at least one embodiment, and as discussed in greater detail below, the portion of third binding portion 70 that is disposed within receiving structure 66 may be movable within and relative to receiving structure 66.

In the exemplary embodiments illustrated in FIGS. 5A-5C, binding assembly 50 may also comprise a heel strap 75 removably attached to third binding portion 70. As seen in FIG. 5B, heel strap 75 may comprise an enlarged first end 77 and an opposing second end 79. In certain embodiments, heel strap 75 may be removably attached to third binding portion 70 by wrapping second end 79 of heel strap 75 around a portion of third binding portion 70 and then inserting a fastening structure 76 provided proximate second end 79 through a fastening aperture 78 defined through heel strap 75, as illustrated in FIG. 5C. As with fastening structure 63 and fastening aperture 72, fastening structure 76 and fastening aperture 78 may be formed in any number of shapes and sizes. In certain embodiments, the enlarged first end 77 of heel strap 75 may provide a convenient and easily graspable structure for a wearer of exemplary snowshoe 10 to grasp and pull to manipulate third binding portion 70, even while wearing protective clothing such as gloves or mittens.

As illustrated in FIGS. 5B and 5C, a receiving structure 68 may be provided on a portion of second binding portion 65. Similar to receiving structures 61 and 66, receiving structure 68 may be sized to receive additional binding portions of binding assembly 50. For example, as illustrated in FIGS. 5B and 5C, receiving structure 68 may be sized to receive a portion of a strap 86. Strap 86 generally represents any form or type of binding structure or feature capable of removably securing binding assembly 50 to a wearer's footwear. Examples of strap 86 include, without limitation, straps, cords, strings, ropes, or the like. Strap 86 may also be formed of any number or combination of materials; including, for example, nylon, elastomers, cotton, or any other suitable material. In addition, each of the receiving structures provided on first binding portion 60 (e.g., receiving structures 61) and second binding portion 65 (e.g., receiving structures 66 and 68) may be formed in any number of shapes and sizes.

In at least one embodiment, and as illustrated in FIGS. 5B and 5C, a first end 87 of strap 86 may be affixed to a portion of second binding portion 65 by inserting first end 87 through an aperture defined in receiving structure 68, looping a portion of strap 86 around receiving structure 68, and then affixing first end 87 to strap 86. Alternatively, receiving structure 86 may be omitted and first end 87 of strap 86 may be directly affixed to a portion of second binding portion 65. An opposing second end 89 of strap 86 may then be inserted into and passed through a first fastening structure 80 affixed to a portion of first binding portion 60. Subsequently, the second end 89 of strap 86 may be inserted into and passed through a second fastening structure 81 affixed to first binding portion 60. The second end 89 of strap 86 may then be affixed to a portion of second binding portion 65 proximate its second end 73. In certain embodiments, a handle portion 88 may be disposed over a portion of strap 86 that is positioned between first fastening structure 80 and second fastening structure 81. Handle portion 88 generally represents any type or form of graspable structure and may, as discussed in greater detail below, provide a convenient and easily graspable structure for a wearer of exemplary snowshoe 10 to grasp and pull to manipulate strap 86. Handle portion 88 may be formed of any number or combination of materials; including, for example, plastic, natural or synthetic rubber (such as polychloroprene), thermoplastic elastomers, or any other suitable material.

Fastening structures 80 and 81 generally represent any type or form of fastening structure or assembly capable of removably fastening at least a portion of strap 86 to first binding portion 60. Examples of fastening structures 80 and 81 include, without limitation, buckles, loops, clasps, or any other suitable fastener or fastening means. In at least one embodiment, and as illustrated in FIGS. 5A and 5C, fasteners 80 and 81 may be elastically biased one-way loop-type buckles. As illustrated in FIG. 5C, fasteners 80 and 81 may comprise a looped portion 82 and an elastically biased engaging portion 83 configured to biasedly engage a portion of strap 86. In certain embodiments, a plurality of teeth 84 provided on elastically biased engaging portion 83 may, when elastically biased against strap 86, only allow strap 86 to travel in a single direction. For example, teeth 84 on engaging portion 83 may allow strap 86 to be pulled and tightened about binding assembly 50 (thereby tightening binding assembly 50 about a wearer's footwear), but prevent strap 86 from being loosened from about binding assembly 50.

Figure 6A:
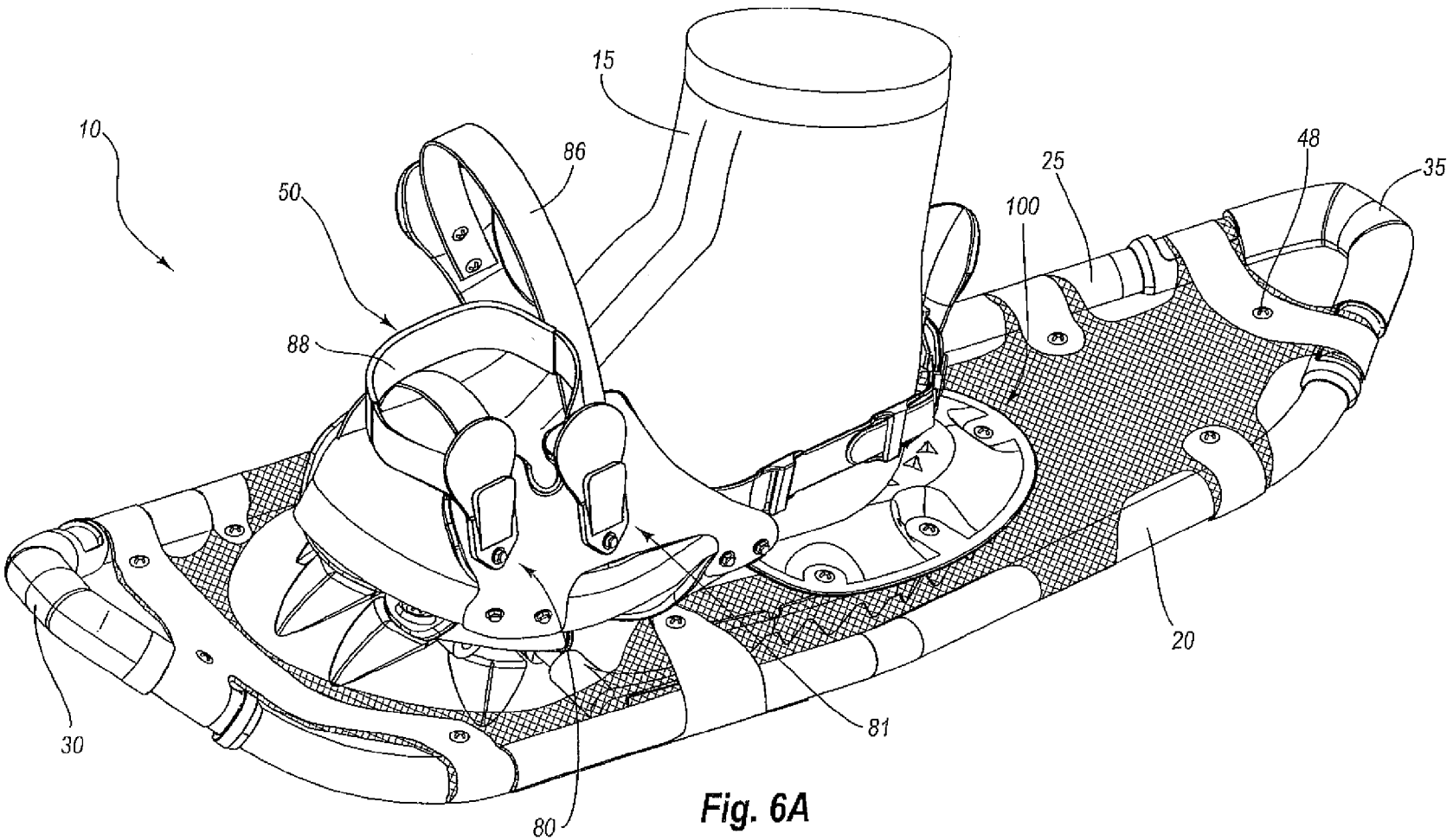
FIG. 6A is a perspective view of an exemplary snowshoe apparatus comprising a binding assembly in a first position.
Figure 6B:
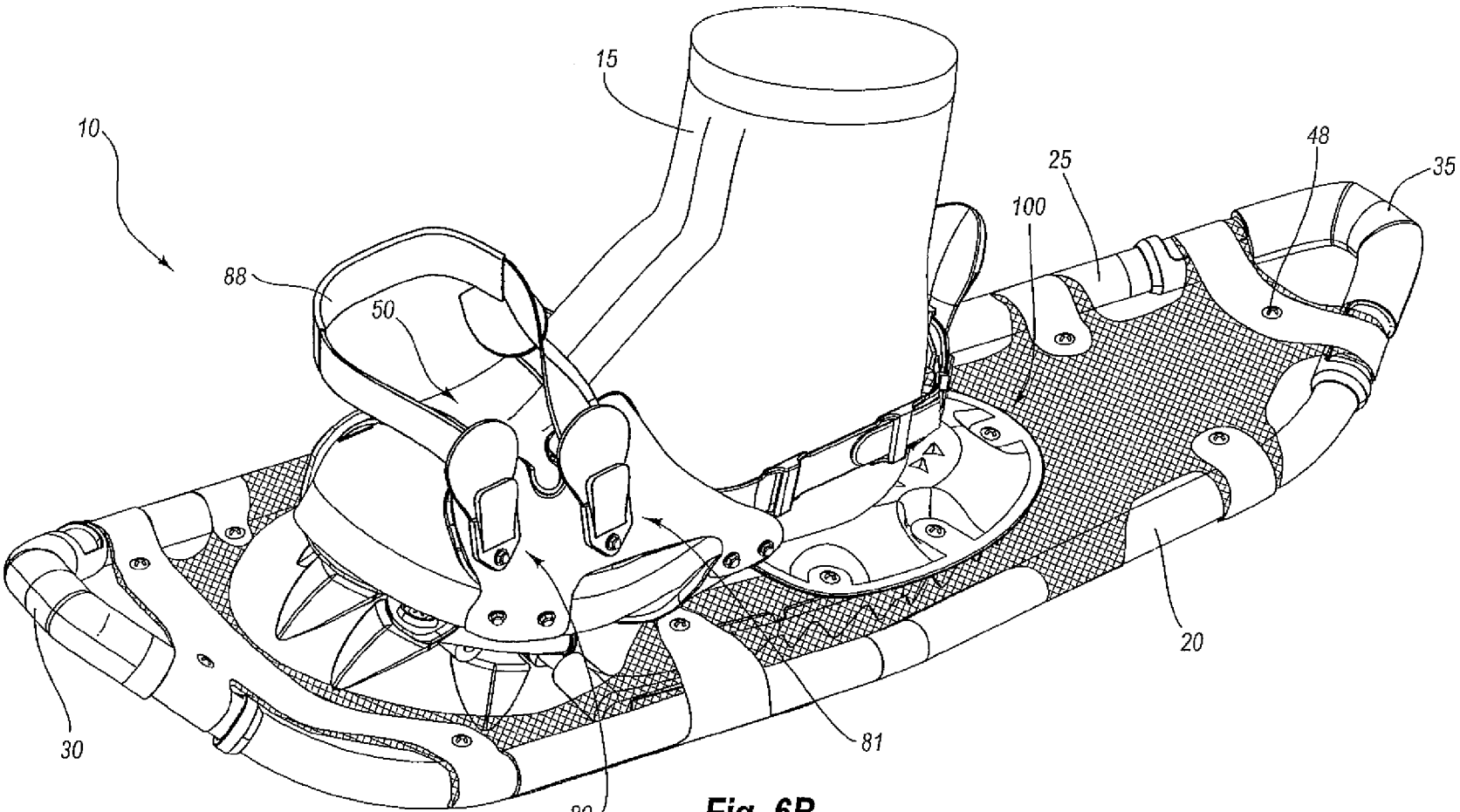
FIG. 6B is a perspective view of an exemplary snowshoe apparatus comprising a binding assembly in a second position.

For example, as illustrated in FIGS. 6A and 6B, a wearer of exemplary snowshoe 10 may tighten strap 86 and binding assembly 50 about a wearer's footwear 15 by pulling strap 86 upwards using handle portion 88. In this example, as handle portion 88 is pulled upward, strap 86 may be tightened to secure and tighten first binding portion 60, second binding portion 65, and third binding portion 70 about footwear 15. For example, pulling on strap 86 using handle portion 88 may cause the second end 73 of third binding portion 70 to move across footwear 15 and towards second fastening structure 81 on first binding portion 60, thus tightening third binding portion 70 about a heel portion of footwear 15. Similarly, pulling upwards on strap 86 using handle portion 88 may cause a portion of second binding portion 65 to move towards first fastening structure 80 on first binding portion 60, thus tightening first binding portion 60 and second binding portion 65 about a toe portion of footwear 15. Pulling upwards on strap 86 using handle portion 88 may also cause first, second, and third binding portions 60, 65, and 70 to be tightened about an ankle portion of footwear 15.

In certain embodiments, once strap 86 and binding assembly 50 have been tightened about footwear 15, elastically biased engaging portion 83 may prevent strap 86 and, in turn, binding assembly 50 from being loosened from about footwear 15. In this example, strap 86 may only be loosened from about footwear 15 by disengaging the engaging portion 83 of fasteners 80 and 81 from strap 86. In at least one embodiment, this may be accomplished by pulling a flap 85 attached to engaging portion 83 out and away from strap 86, thus disengaging the engaging portion 83 (and teeth 84) from strap 86. Accordingly, the various components of binding assembly 50 may prevent strap 86 and binding assembly 50 from being accidentally loosened from about footwear 15 during snowshoeing activities. In addition, because exemplary binding assembly 50 may be completely and securely tightened about footwear 15 in a single step using a single hand (e.g., by pulling on handle portion 88), exemplary binding assembly 50 may provide a convenient mechanism for quickly and reliably securing a snowshoe to a wearer's footwear.

In at least one embodiment, and as illustrated in FIGS. 5B and 5C, first and second binding portions 60 and 65 may comprise one or more raised traction elements 64. In certain embodiments, traction elements 64 (which may be formed in any number of shapes and sizes) may help prevent a wearer's footwear or shoe (such as footwear 15) from sliding within binding portions 60 and 65 during snowshoeing. A plurality of fastener apertures 62 may also be defined throughout first and second binding portions 60 and 65 and sized to receive a fastener used to couple binding portions 60 and 65 to first and second crampons 52 and 54. For example, as illustrated in FIG. 5B, first crampon 52 may be coupled to first binding portion 60 by inserting a fastener through fastener apertures 51 (FIG. 7) and 62 (FIG. 5B) defined in first crampon 52 and first binding portion 60, respectively. Similarly, second crampon 54 may be coupled to second binding portion 65 by inserting a fastener through fastener apertures 51 and 62 defined in second crampon 54 and second binding portion 65, respectively. In an additional embodiment, first crampon 52 may be integrally formed with first binding portion 60, resulting in a unitary, one-piece construction. Similarly, second crampon 54 may be integrally formed with second binding portion 65, resulting in a unitary, one-piece construction.

Figure 7:
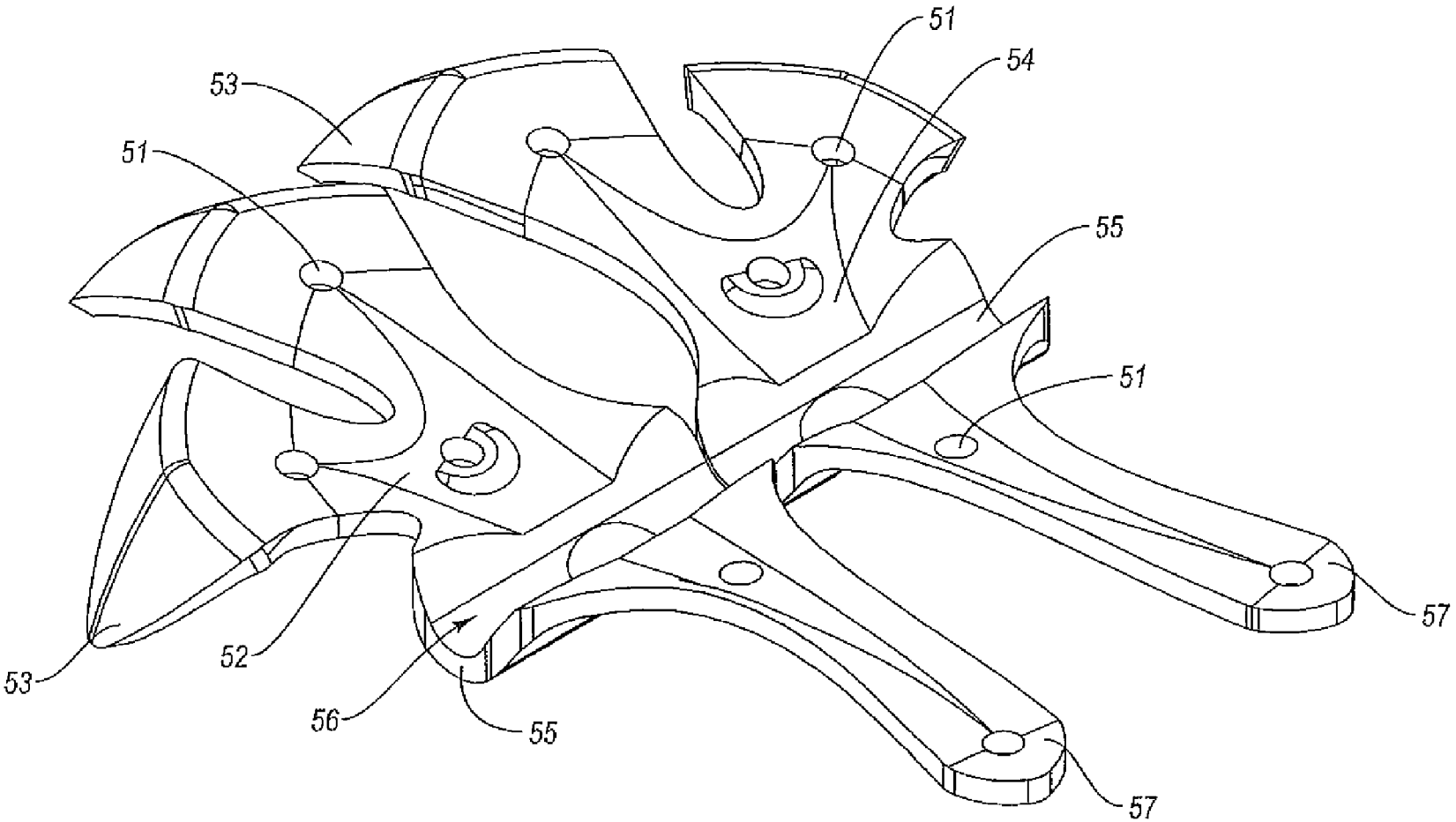
FIG. 7 is a perspective view of an exemplary crampon assembly according to at least one embodiment.

FIG. 7 is a perspective view of an exemplary crampon assembly comprising a first crampon 52 and a second crampon 54. Crampons 52 and 54, which may be formed in any number of shapes and sizes, generally represent any type or form of structure capable of engaging terrain beneath exemplary snowshoe 10. Examples of crampons 52 and 54 include, without limitation, cleats, spikes, teeth, claw-shaped members, and the like. Crampons 52 and 54 may be formed of any number or combination of materials; including, for example, stainless or carbon steel, aluminum, titanium, or any other suitable material. As illustrated in FIG. 7, first and second crampons 52 and 54 may comprise one or more terrain engaging portions 53 configured to engage the terrain below exemplary snowshoe 10. As with the remainder of crampons 52 and 54, terrain engaging portions 53 may be formed in any number of shapes and sizes. As discussed above, a plurality of fastener apertures 51 may also be defined throughout first crampon 52 and second crampon 54 and sized to receive a fastener used to couple crampons 52 and 54 to first and second binding portions 60 and 65.

In at least one embodiment, binding assembly 50 may be pivotally attached to a portion of pivot assembly 90. For example, as illustrated in FIGS. 5A and 5C, crampons 52 and 54 may, when coupled to first and second binding portions 60 and 65, define a transverse channel 56 sized to house a portion of pivot assembly 90. In this example, crampons 52 and 54 may comprise a semi-cylindrical portion 55 that, together with the bottom surfaces of first and binding portions 60 and 65, defines transverse channel 56. In at least one embodiment, binding assembly 50 may be pivotally attached to pivot assembly 90 by sandwiching a portion of pivot assembly 90 (such as, for example, pivot rod 98, as discussed in greater detail below) between crampons 52 and 54 and binding portions 60 and 65 within the transverse channel 56 defined by semi-cylindrical portions 55 and the bottom surfaces of binding portions 60 and 65. One or more fasteners may then be inserted into and through the fastener apertures 62 and 51 defined in binding portions 60 and 65 and crampons 52 and 54 to securely fasten crampons 52 and 54 to binding portions 60 and 65.

Figure 8A:
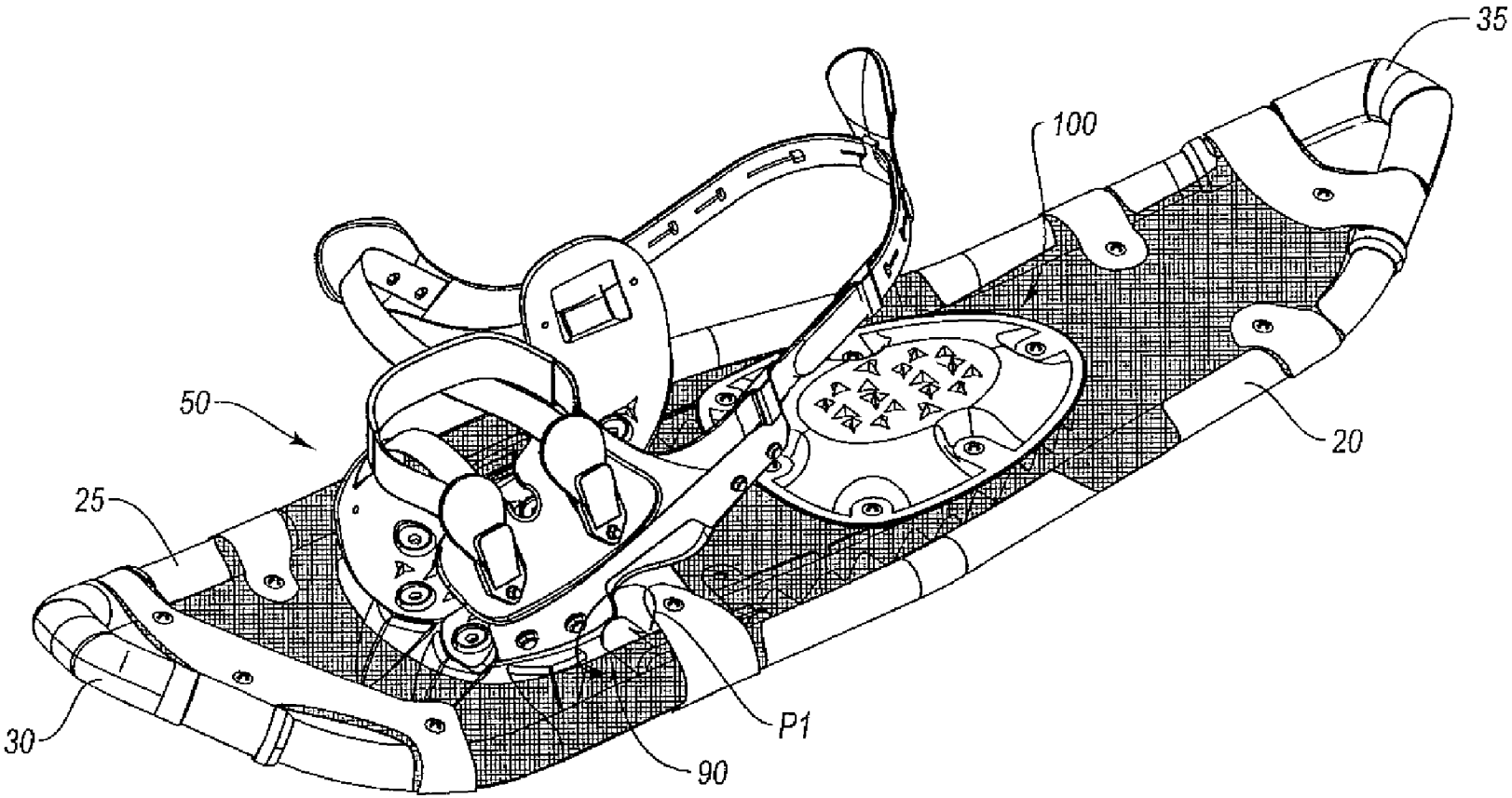
FIG. 8A is a perspective view of an exemplary snowshoe apparatus according to at least one embodiment.
Figure 8B:
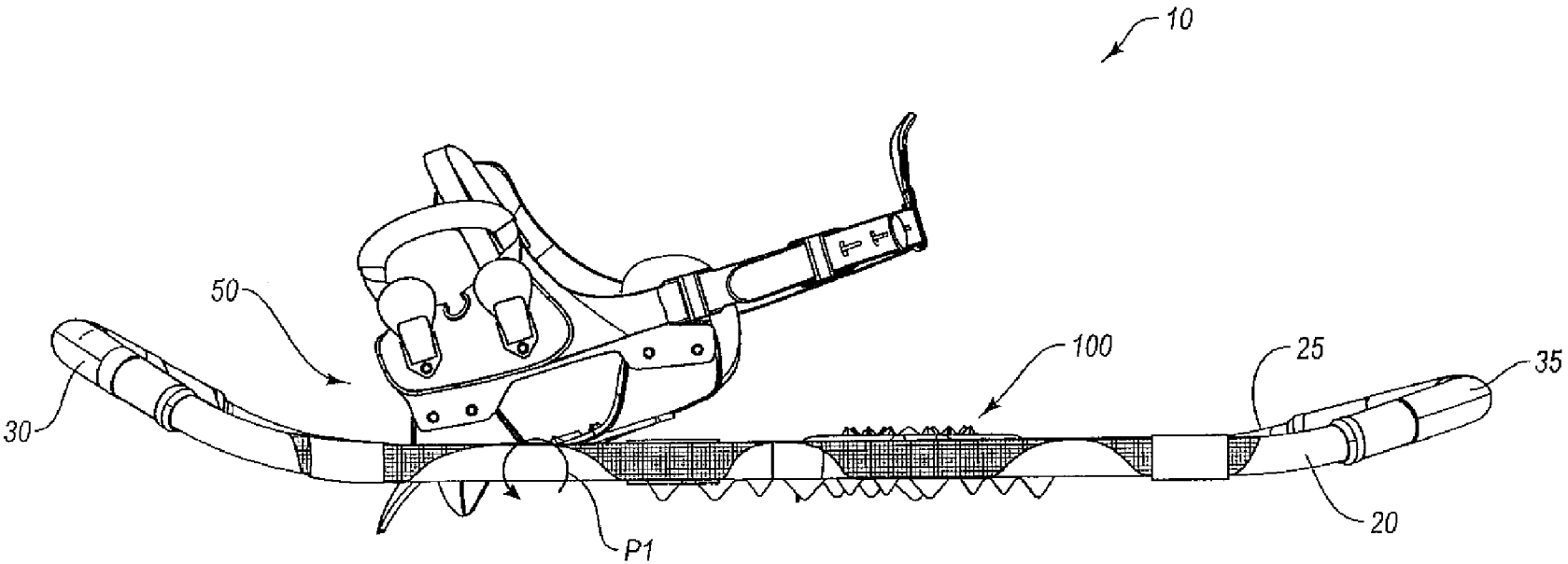
FIG. 8B is a side elevation view of the exemplary snowshoe apparatus illustrated in FIG. 8A.

FIG. 8A is perspective view of an exemplary snowshoe 10 according to at least one embodiment. As illustrated in this figure, in at least one embodiment exemplary binding assembly 50 may be configured to pivot about at least a portion of pivot assembly 90. For example, binding assembly 50 may be configured to pivot about pivot rod 98 (illustrated in FIG. 2), which may be sandwiched between crampons 52 and 54 and first and second binding portions 60 and 65. Specifically, as illustrated in FIG. 8A, binding assembly 50 may pivot downward about an axis P1 defined by pivot rod 98 of pivot assembly 90. In at least one embodiment, and as illustrated in FIG. 8B, a wearer of exemplary snowshoe 10 may pivot binding assembly 50 downward about axis P1 to engage the terrain engaging portions 53 of first and second crampons 52 and 54 with the terrain beneath snowshoe 10.

Figure 9A:
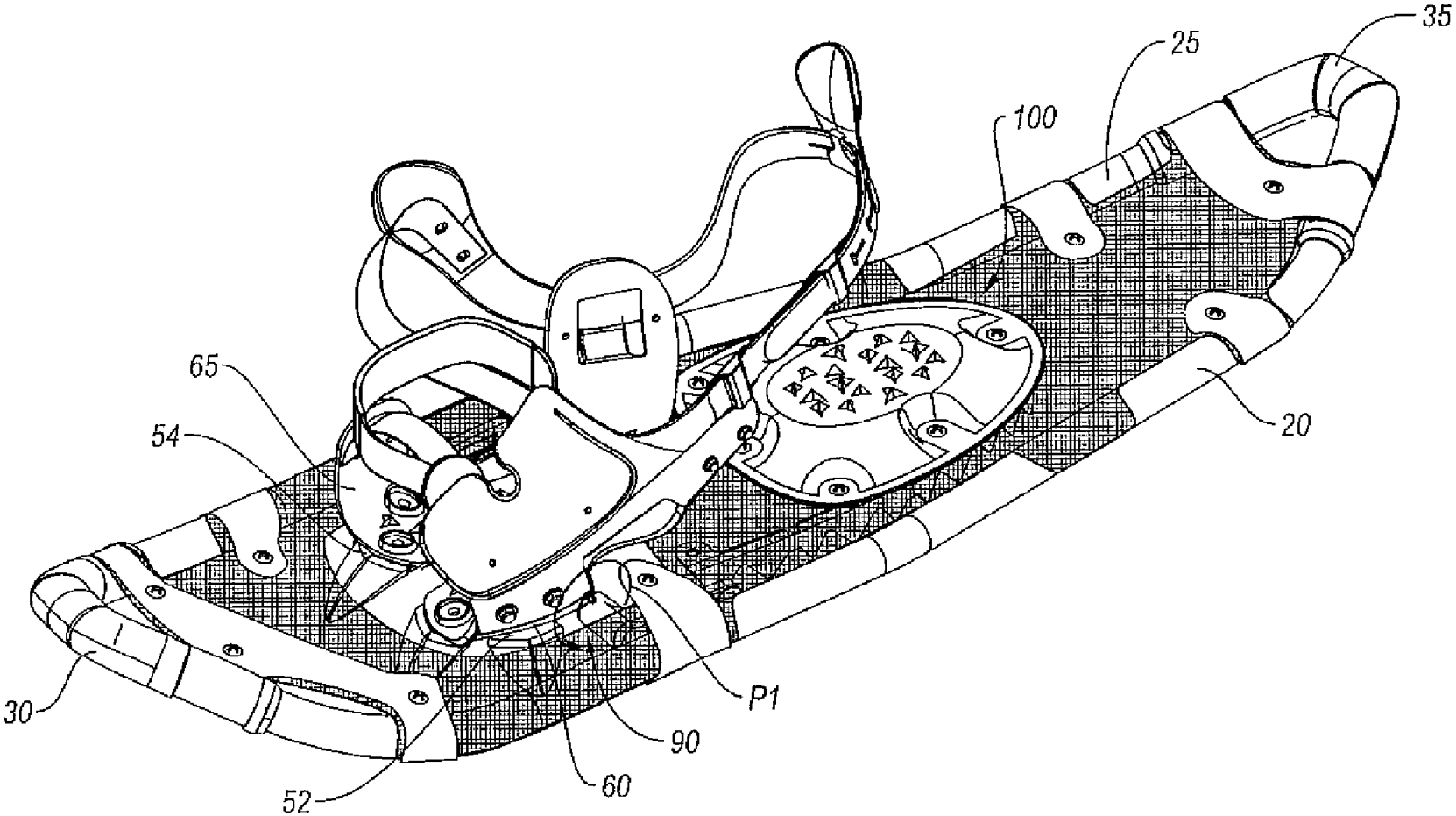
FIG. 9A is a perspective view of an exemplary snowshoe apparatus according to at least one embodiment.
Figure 9B:
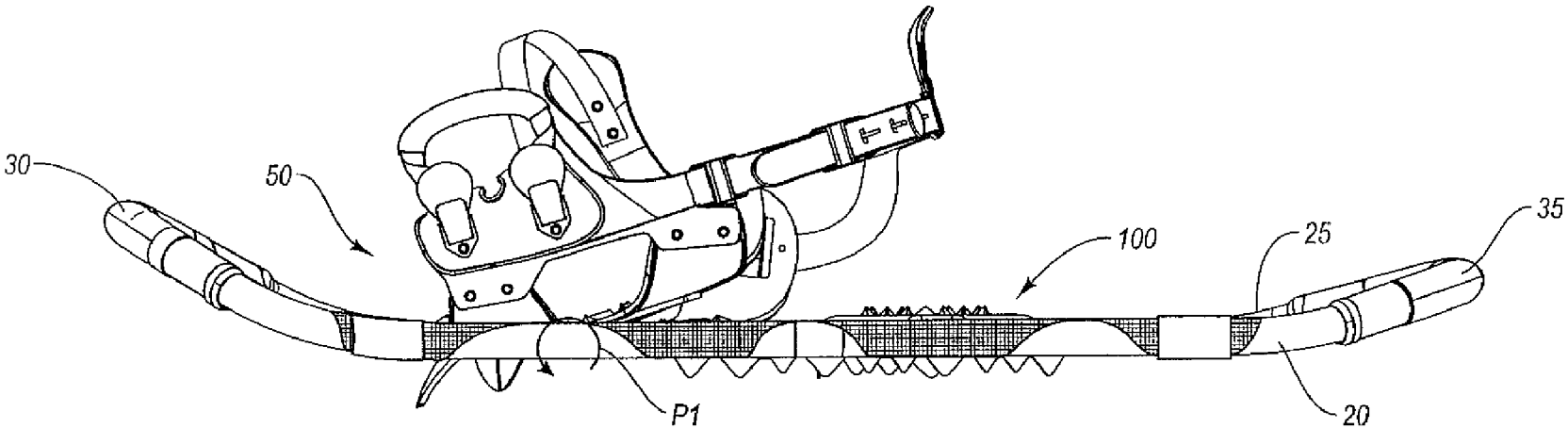
FIG. 9B is a side elevation view of the exemplary snowshoe apparatus illustrated in FIG. 9A.

FIGS. 9A and 9B are perspective and side views, respectively, of an exemplary snowshoe 10 according to at least one embodiment. As detailed above in connection with FIGS. 5A-7, first crampon 52 may be fastened to first binding portion 60, while second crampon 54 may be fastened to second binding portion 65. In at least one embodiment, first crampon 52 and first binding portion 60 may be configured to pivot about at least a portion of pivot assembly 50 substantially independent of second crampon 54 and second binding portion 65. For example, as illustrated in FIGS. 9A and 9B, first crampon 52 and first binding portion 60 (together comprising a lateral half of binding assembly 50) may pivot about an axis P1 defined by pivot rod 98 of pivot assembly 90, while second crampon 54 and second binding portion 65 (together comprising a medial half of binding assembly 50) remain stationary. Although not illustrated, the opposite is also possible. Specifically, second crampon 54 and second binding portion 65 may pivot about an axis P1 defined by pivot rod 98 of pivot assembly 90, while first crampon 52 and first binding portion 60 remain stationary.

Advantageously, by allowing first crampon 52 and first binding portion 60 to pivot about pivot rod 98 independent of second crampon 54 and second binding portion 65, the exemplary embodiment illustrated in FIGS. 9A and 9B may provide a more natural and comfortable walking experience for a wearer of exemplary snowshoe 10. This exemplary configuration may also enable the terrain engaging portions 53 of first and second crampons 52 and 54 to more fully and securely engage the terrain below snowshoe 10 during snowshoeing.

Figure 10A:
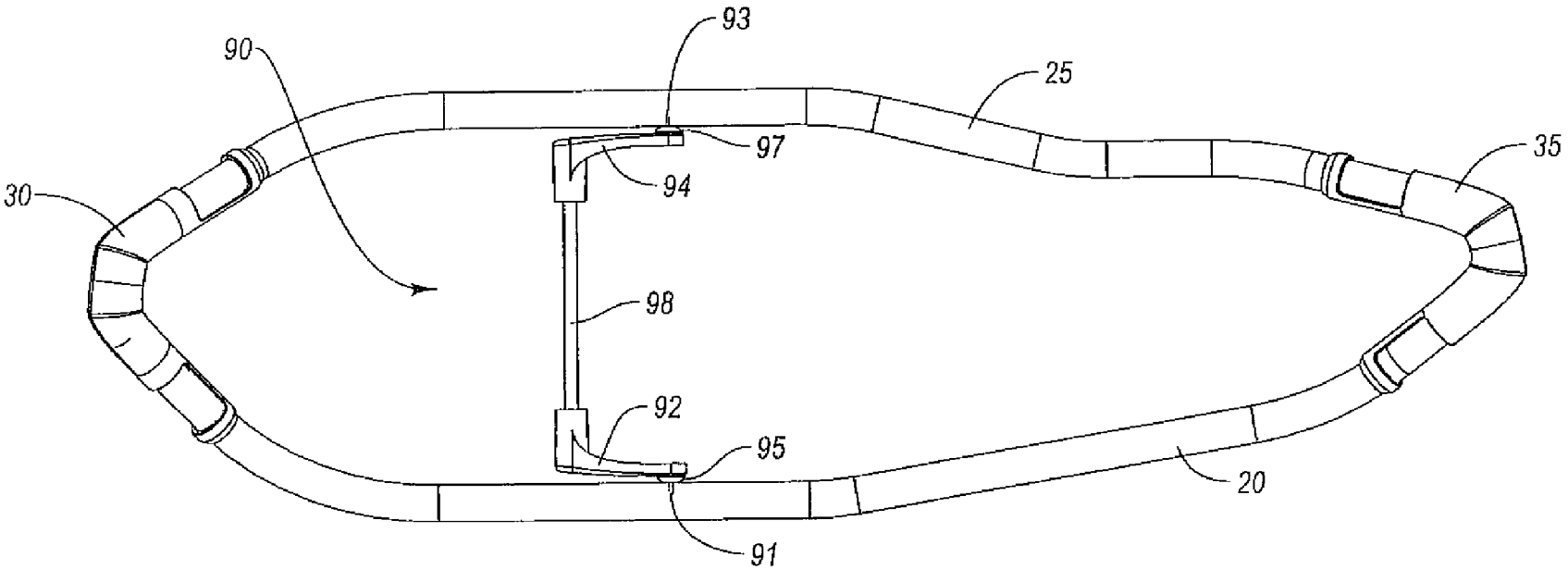
FIG. 10A is a top view of an exemplary pivot assembly attached to a snowshoe frame assembly according to at least one embodiment.

FIG. 10A is a top view of an exemplary pivot assembly 90 pivotally attached to the frame assembly of exemplary snowshoe 10. As illustrated in this figure, pivot assembly 90 may comprise a first pivot arm 92 pivotally attached to first rail 20 by a pin 91 disposed within a bushing 95. Similarly, pivot assembly 90 may also comprise a second pivot arm 94 pivotally attached to second rail 25 by a pin 93 disposed within a bushing 97. In at least one embodiment, a pivot rod 98 may be disposed between and couple first pivot arm 92 to second pivot arm 94. The various components of pivot assembly 90 (e.g., pins 91 and 93, pivot arms 92 and 94, bushings 95 and 97, and pivot rod 98) may be formed in any number of shapes and sizes and from any number or combination of materials; including, for example, stainless or carbon steel, aluminum, brass, plastic, or any other suitable material.

In addition, in at least one embodiment, pivot rod 98 may be formed of a flexible material, such as plastic, a thermoplastic elastomer, a natural or synthetic rubber, or any other suitable material. In this exemplary embodiment, the flexible material of pivot rod 98 may allow pivot rod 98 to flex downwards as pressure is applied to pivot rod 98 by a wearer of snowshoe 10. When this pressure is removed (such as when the wearer of snowshoe 10 lifts his/her foot to disengage crampons 52 and 54 from terrain beneath snowshoe 10), the flexible bias of pivot rod 98 may help disengage the terrain engaging portions 53 of crampons 52 and 54 from the terrain beneath snowshoe 10. In many embodiments, the level of flexibility or stiffness of the material used to form pivot rod 98 may be chosen based on the desired application and/or type of snowshoeing activity. In an additional embodiment, pivot rod may be formed of a rigid material, such as stainless or carbon steel, aluminum, titanium, carbon fiber composite, or any other suitable material.

Figure 10B:
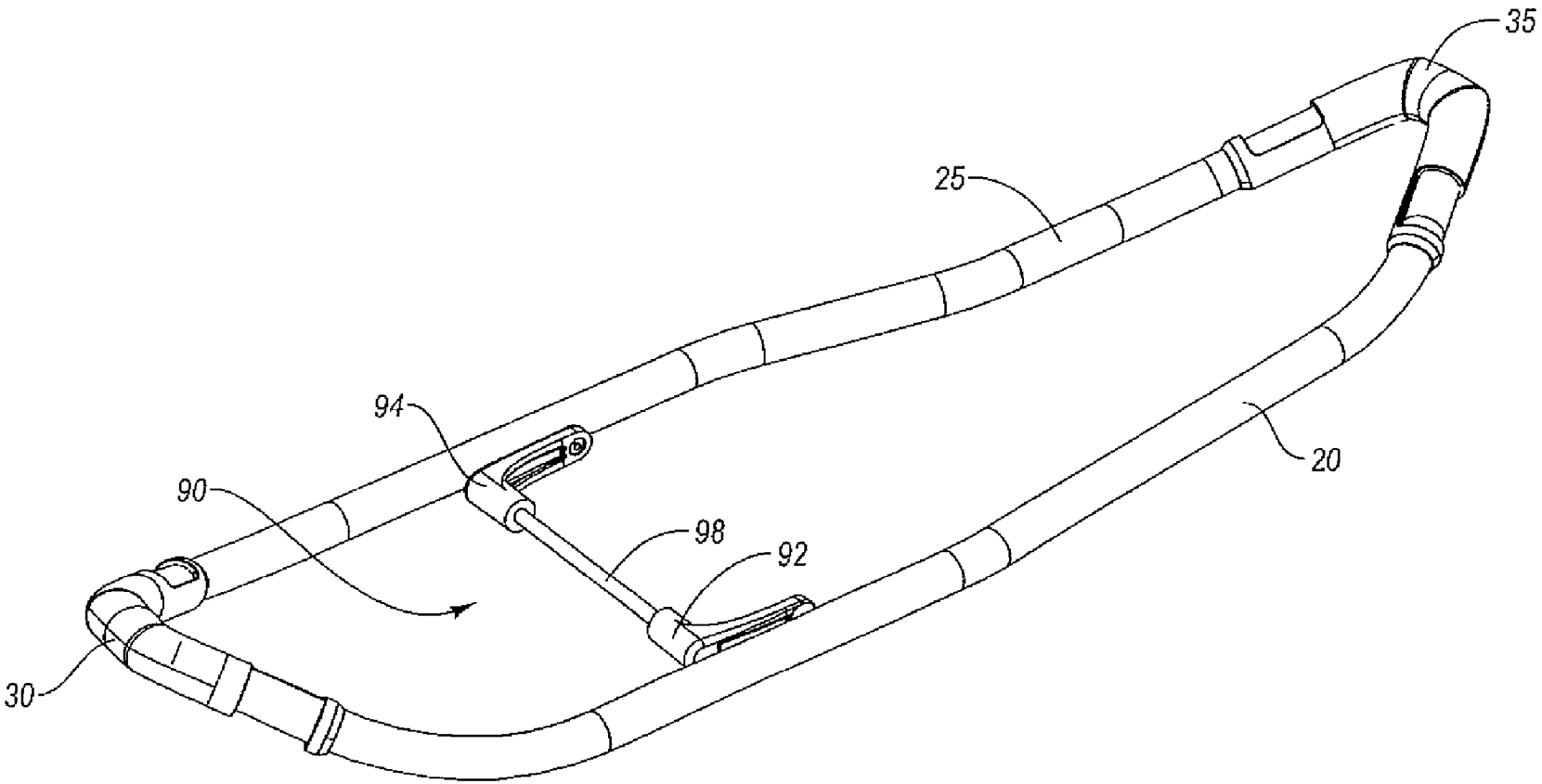
FIG. 10B is a perspective view of the exemplary pivot and snowshoe frame assembly illustrated in FIG. 10A, with the pivot assembly in a first position.
Figure 10C:
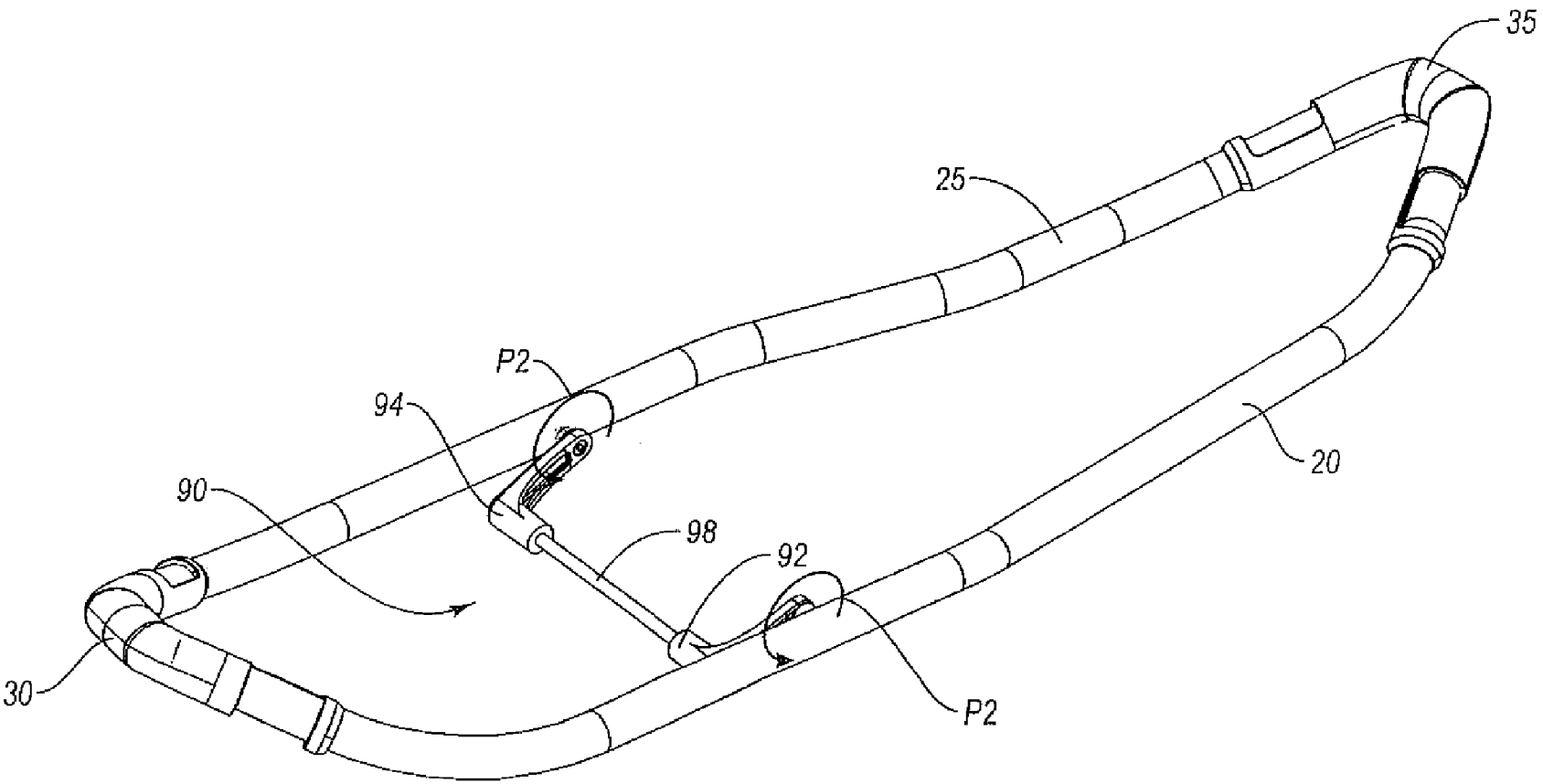
FIG. 10C is a perspective view of the exemplary pivot and snowshoe frame assembly illustrated in FIG. 10A, with the pivot assembly in a second position.

FIGS. 10B and 10C are perspective views of the exemplary pivot assembly 90 and snowshoe 10 illustrated in FIG. 10A. In at least one embodiment, at least a portion of pivot assembly 90 may be configured to pivot relative to the frame assembly (e.g., first and second rails 20 and 25) of snowshoe 10. For example, as illustrated in FIGS. 10B and 10C, pivot arms 92 and 94, along with pivot rod 98 coupled thereto, may pivot relative to the frame assembly of snowshoe 10 about an axis P2 (defined by pins 91 and 93) from a first position (illustrated in FIG. 10B) to a second position (illustrated in FIG. 10C). In at least one embodiment, pivot assembly 90 may enable a wearer of snowshoe 10 to more fully and securely engage the terrain engaging portions 53 of first and second crampons 52 and 54 with the terrain below snowshoe 10 during snowshoeing.

In certain embodiments, first pivot arm 92 and second pivot arm 94 may be configured to pivot substantially independent of one another. For example, in one embodiment first pivot arm 92 may pivot relative to the frame assembly in a first direction while second pivot arm 94 remains substantially stationary, or vice-versa. Similarly, first pivot arm 92 may pivot relative to the frame assembly in a first direction while second pivot arm 94 may simultaneously pivot in a second direction that is opposite to the first direction of first pivot arm 92. Pivoting one or more of pivot arms 92 and 94 in this manner may result in pivot rod 98 being angled relative to the horizontal plane defined by the frame assembly. In at least one embodiment, this configuration may enable a wearer of exemplary snowshoe 10 to walk in a more natural or upright position when snowshoeing sideways on a sloped terrain. In addition, in embodiments where pivot rod 98 is formed of a flexible material, the flexible material of pivot rod 98 may allow pivot rod 98 to angle or flex as pivot arms 92 and 94 are pivoted in opposite directions.

As detailed above in connection with FIG. 7, exemplary snowshoe 10 may comprise a crampon assembly comprising a first crampon 52 and a second, discretely formed, crampon 54 capable of pivoting about at least a portion of pivot assembly 50 substantially independent of first crampon 52. In at least one additional embodiment, at least one of first and second crampons 52 and 54 may also be movable laterally relative to the frame assembly of exemplary snowshoe 10 (i.e., first and second rails 20 and 25).

Figure 11A:
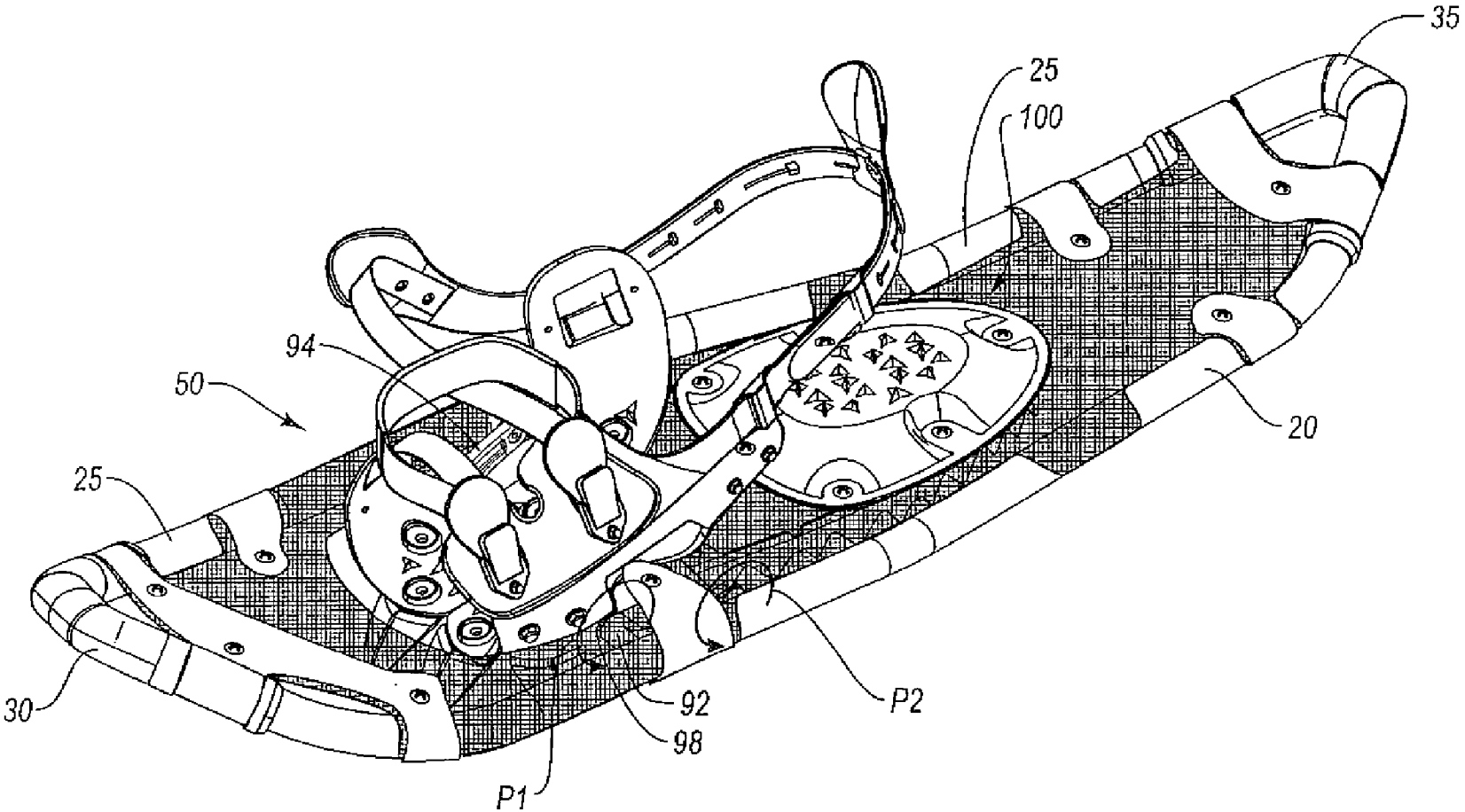
FIG. 11A is a perspective view of an exemplary snowshoe apparatus according to at least one embodiment.
Figure 11B:
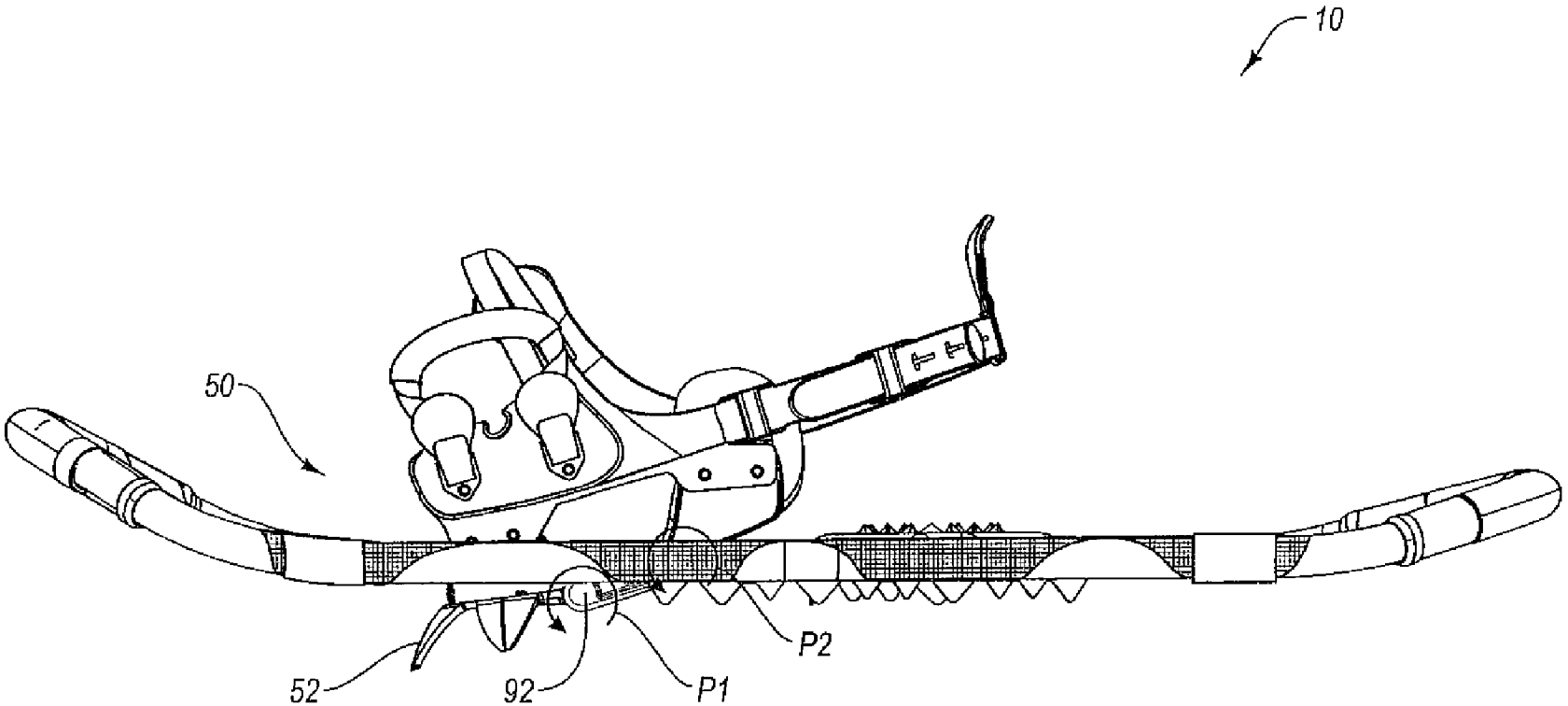
FIG. 11B is a side elevation view of the exemplary snowshoe apparatus illustrated in FIG. 11A.

In certain embodiments, binding assembly 90 may be configured to pivot about two discrete axes; namely, axis P1 (defined by pivot rod 98 and described and illustrated in connection with FIGS. 8A-9B) and axis P2 (defined by pins 91 and 93 and described and illustrated in connection with FIGS. 10A-10C). For example, as illustrated in the perspective and side views of FIGS. 11A and 11B, pivot assembly 90 may pivot: 1) about a portion of pivot assembly 90 (e.g., axis P1 defined by pivot rod 98) and, due to pivot assembly 90, 2) about a second axis P2 defined by pins 91 and 93. In at least one embodiment, this exemplary configuration may enable a wearer of snowshoe 10 to more fully and securely engage the terrain below snowshoe 10 during snowshoeing, resulting in a more secure and comfortable snowshoeing experience for a wearer of snowshoe 10.

Figure 12A:
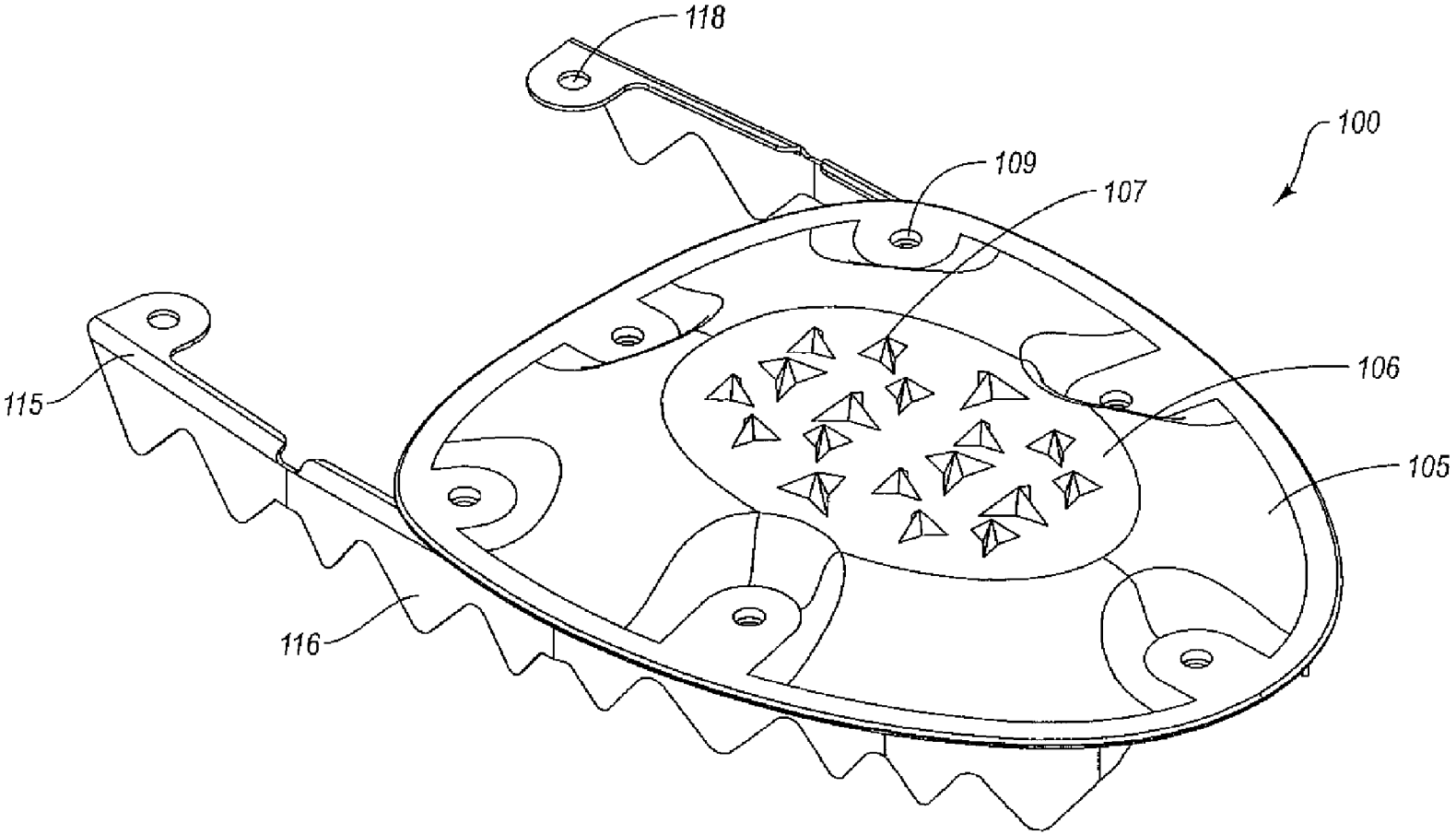
FIG. 12A is a top perspective view of an exemplary heel support assembly according to at least one embodiment.
Figure 12B:
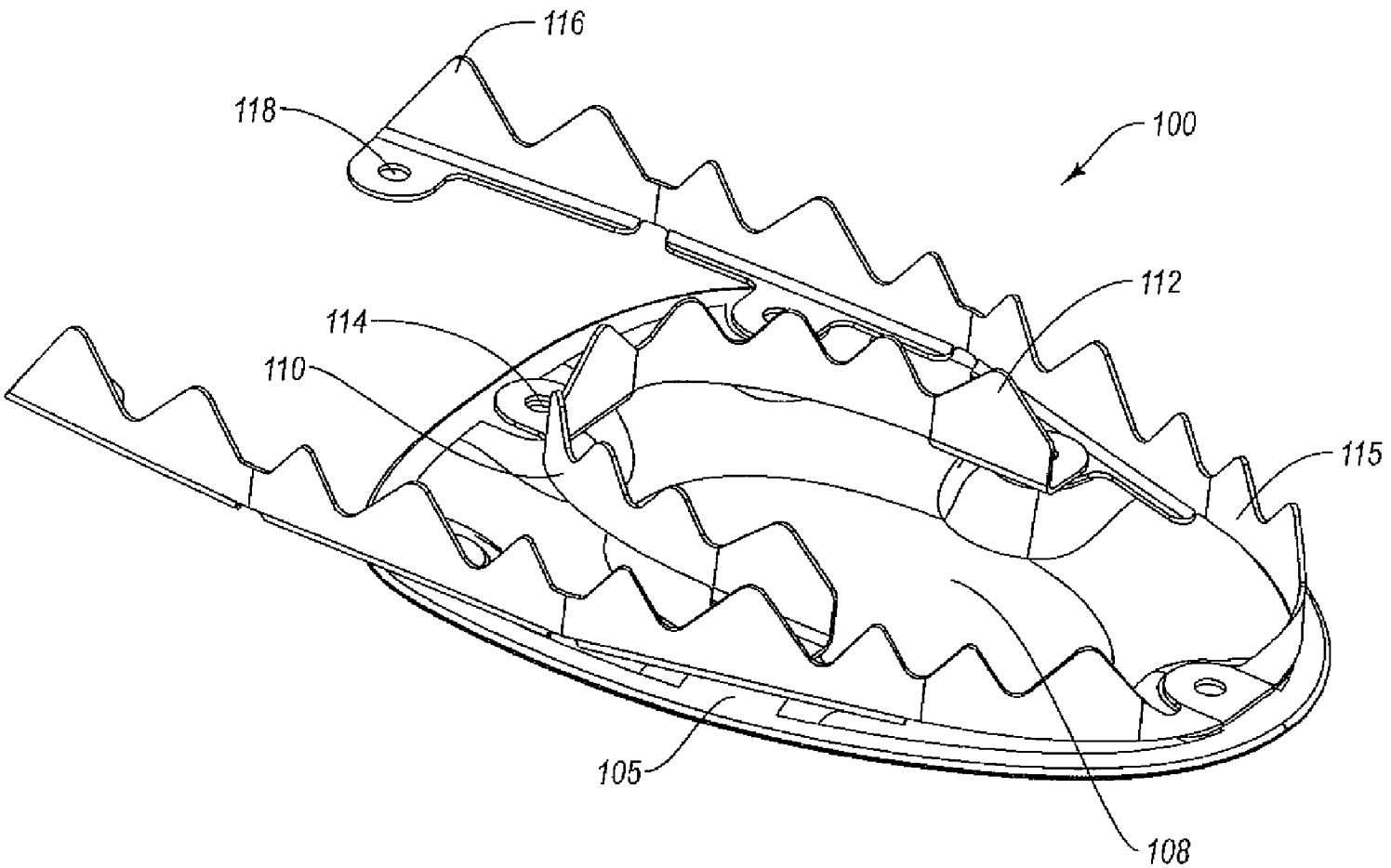
FIG. 12B is a bottom perspective view of the exemplary heel support assembly illustrated in FIG. 12A.

As illustrated in FIGS. 1-2, exemplary snowshoe 10 may also comprise a heel support assembly 100 coupled to deck 40 of the frame assembly. FIGS. 12A and 12B are top and bottom perspective views, respectively, of an exemplary heel support assembly 100. As seen in these figures, in at least one embodiment, heel support assembly 100 may comprise a heel support structure 105, a first traction structure 110 affixed to at least a portion of heel support structure 105, and a second traction structure 115 affixed to at least a portion of heel support structure 105. In at least one embodiment, first traction structure 110 may be affixed to heel support structure 105 by one or more fasteners disposed within corresponding fastener apertures 109 and 114 defined within heel support structure 105 and first traction structure 110, respectively. Similarly, second traction structure 115 may be affixed to heel support structure 105 by one or more fasteners disposed within corresponding fastener apertures 109 and 118 defined within heel support structure 105 and second traction structure 115, respectively. In an additional embodiment, at least one of traction structures 110 and 115 may be affixed to at least a portion of deck 40.

First and second traction structures 110 and 115, which may be formed in any number of shapes and sizes, generally represent any type or form of structure capable of engaging terrain beneath exemplary snowshoe 10. Examples of traction structures 110 and 115 include, without limitation, cleats, spikes, teeth, claw-shaped members, and the like. Traction structures 110 and 115 may be formed of any number or combination of materials; including, for example, stainless or carbon steel, aluminum, titanium, or any other suitable material. As illustrated in FIG. 12B, first traction structure 110 may comprise one or more terrain engaging portions 112 configured to engage the terrain below exemplary snowshoe 10. Similarly, second traction structure 115 may comprise one or more terrain engaging portions 116 configured to engage the terrain below exemplary snowshoe 10. As with the terrain engaging portions 53 described above, terrain engaging portions 112 and 116 may be formed in any number of shapes and sizes.

Heel support structure 105 generally represents any type or form of structure capable of supporting the heel of the footwear of a wearer of exemplary snowshoe 10. Heel support structure 105 may be formed in any number of shapes and sizes and of any number or combination of materials. For example, in at least one embodiment, heel support structure 105 may comprise a top surface 106 and a bottom surface 108. In certain embodiments, top surface 106 may comprise one or more traction members 107 configured to help prevent the footwear of a wearer of exemplary snowshoe 10 from slipping or sliding off of heel support structure 105. As illustrated in FIGS. 12A and 12B, at least a portion of the bottom surface 108 of heel support structure 105 may be substantially concave in shape. Heel support structure 105 may also comprise at least one flexible or semi-rigid, resilient material, such as a thermoplastic elastomer, a natural or synthetic rubber, or any other suitable material.

Figure 13A:
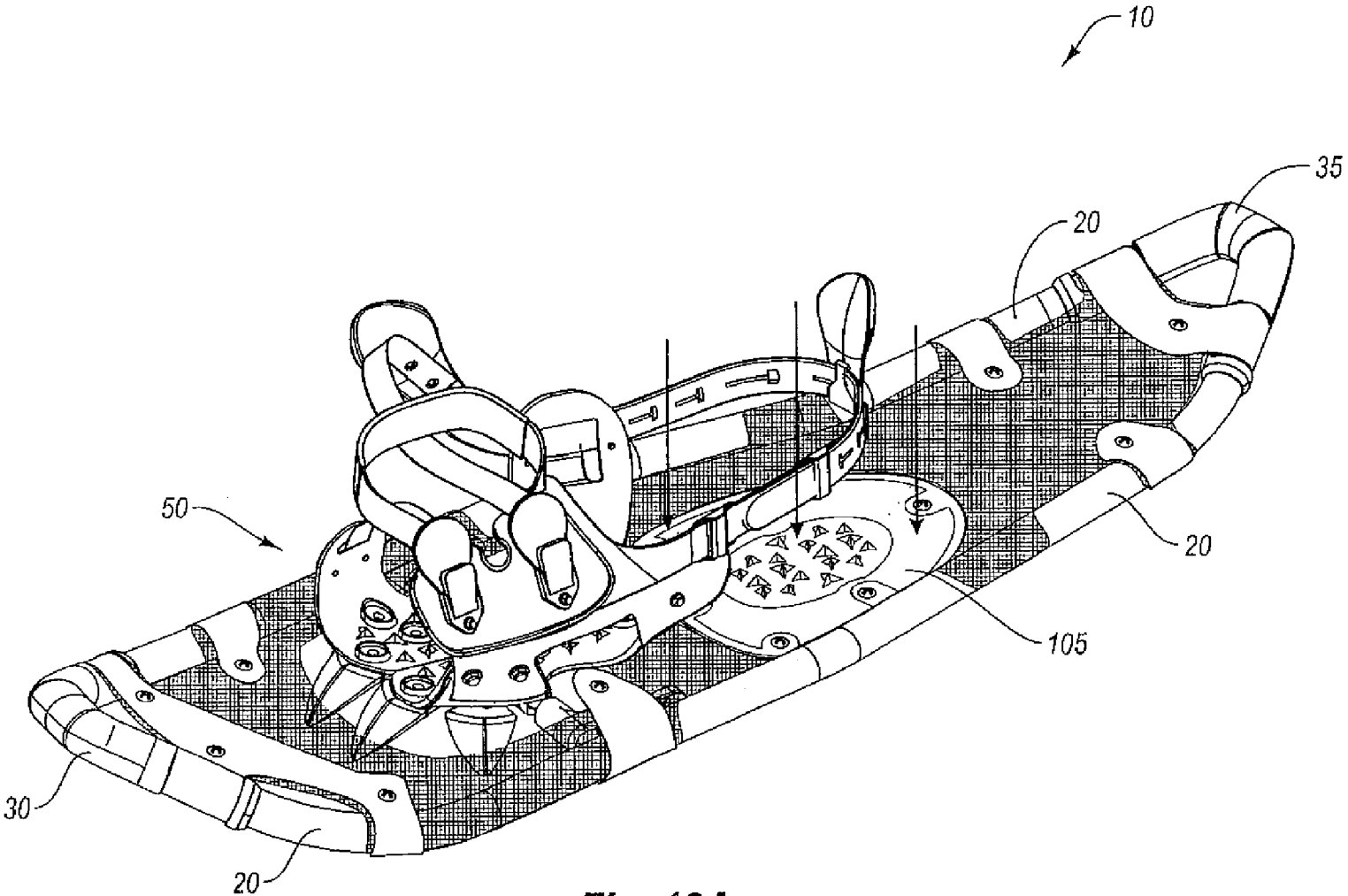
FIG. 13A is a perspective view of an exemplary snowshoe apparatus according to at least one embodiment.
Figure 13B:
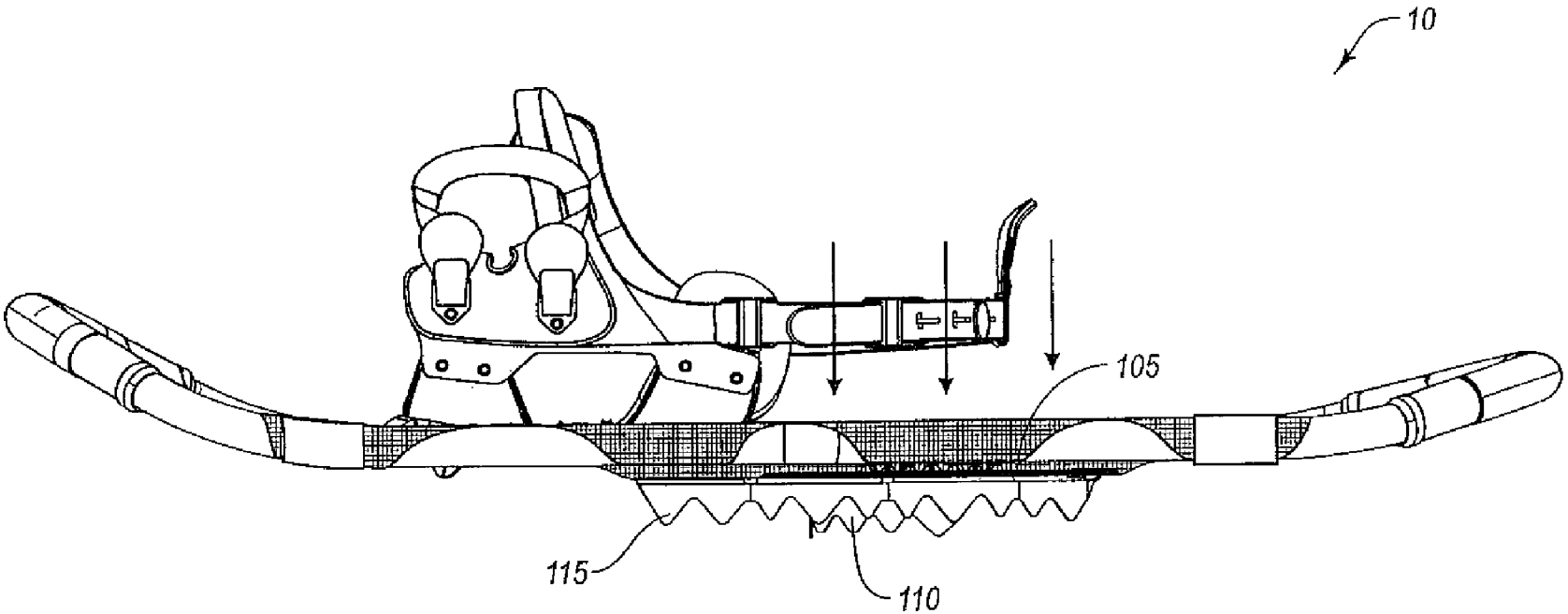
FIG. 13B is a side elevation view of the exemplary snowshoe apparatus illustrated in FIG. 13A.

In many embodiments, portions of heel support assembly 100 may flex downwards as the weight of a wearer of exemplary snowshoe 10 is transferred from the wearer's heel to heel support assembly 100. For example, as illustrated in the perspective and side views of FIGS. 13A and 13B, when the weight of a wearer of exemplary snowshoe 10 is placed upon heel support assembly 100, the force of the wearer's weight may cause the flexible, semi-rigid, or resilient material of heel support structure 105 to flex downwards, which may in turn engage traction structures 110 and 115 with the terrain beneath snowshoe 10. When the force of the wearer's weight is lifted, such as when the wearer pivots his/her footwear about pivot rod 98, the resilient return force of heel support structure 105 may assist the wearer in disengaging traction structures 110 and 115 from the terrain beneath snowshoe 10. Accordingly, heel support assembly 100 may assist a wearer of snowshoe 10 in both engaging and disengaging traction structures 110 and 115 with the terrain beneath exemplary snowshoe 10.

Figure 14A:
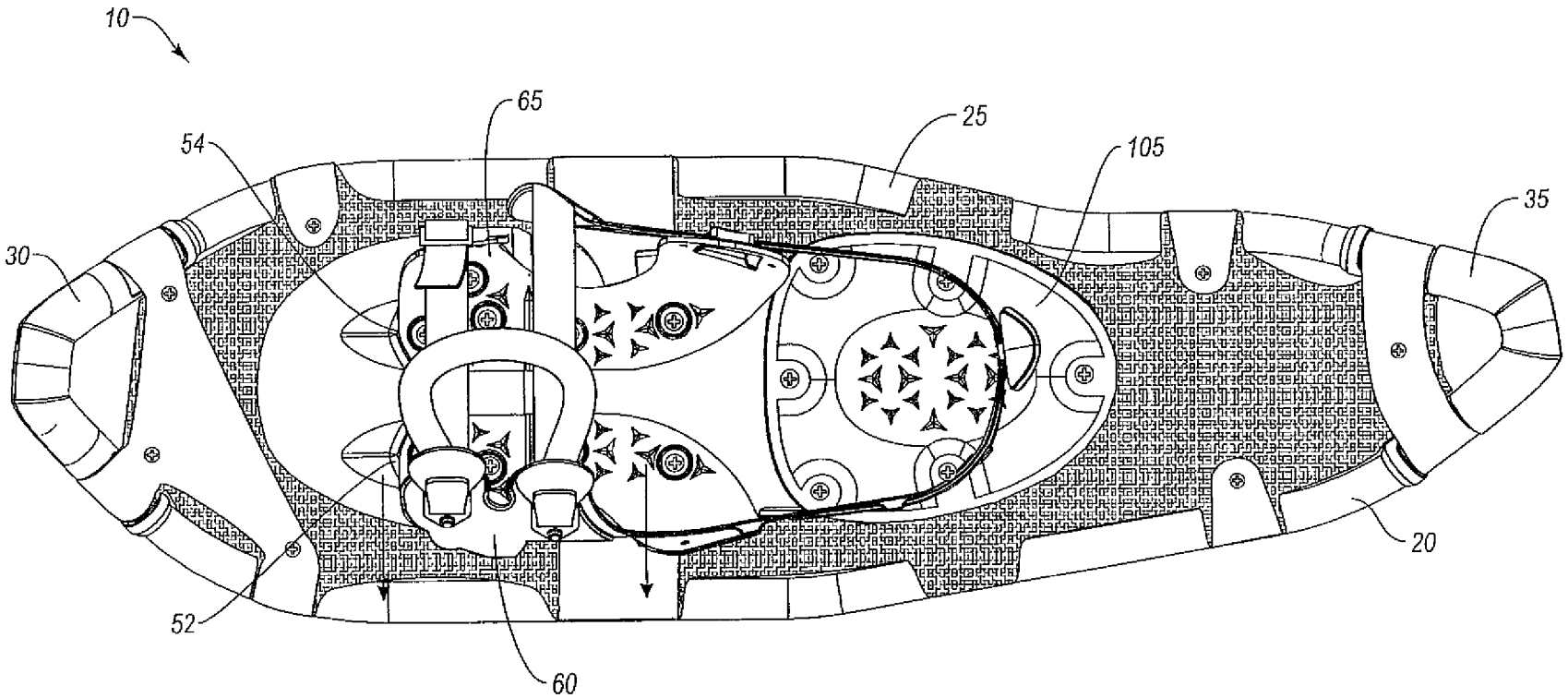
FIG. 14A is a top view of an exemplary snowshoe apparatus according to at least one embodiment.
Figure 14B:
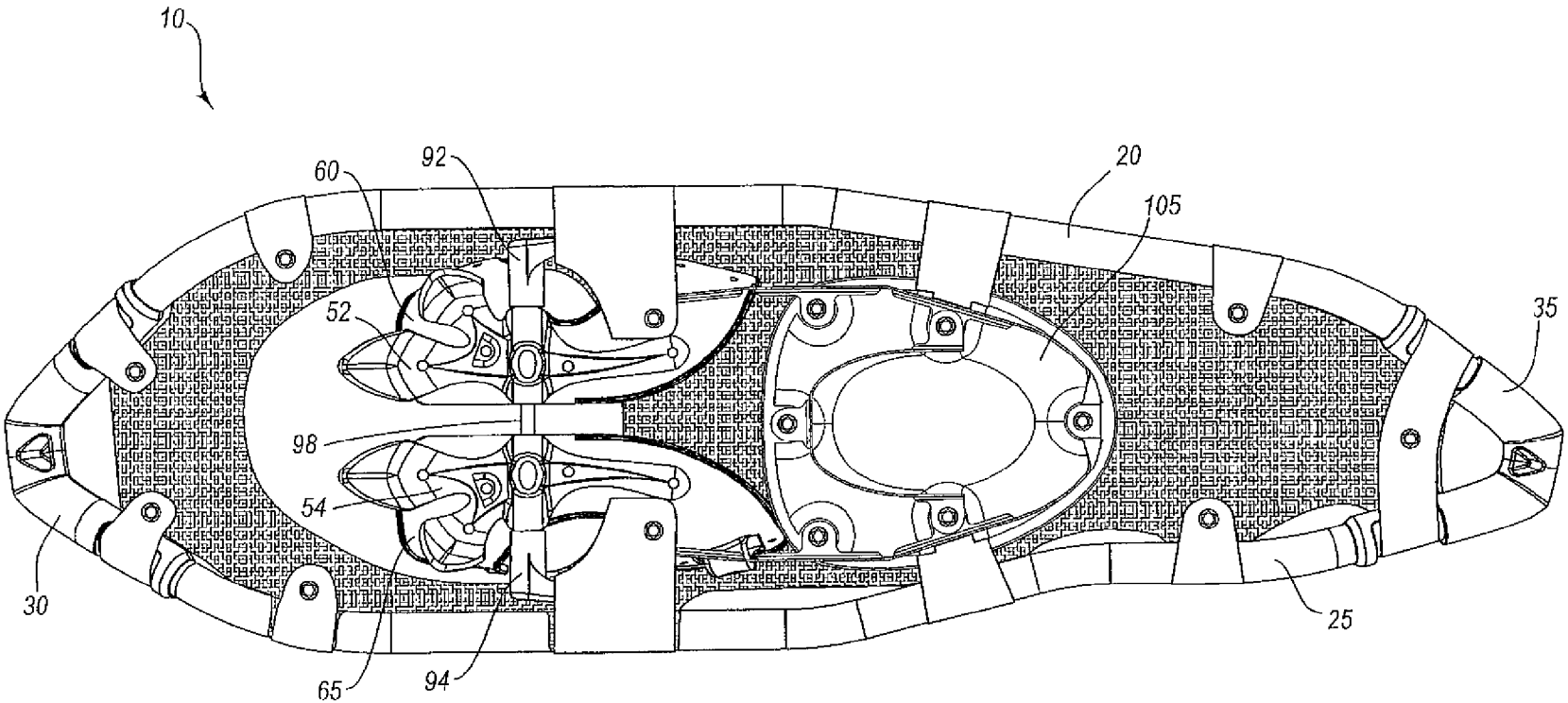
FIG. 14B is a bottom view of the exemplary snowshoe apparatus illustrated in FIG. 14A.

As detailed above in connection with FIG. 7, exemplary snowshoe 10 may comprise a crampon assembly comprising a first crampon 52 and a second, discretely formed, crampon 54 capable of pivoting about at least a portion of pivot assembly 50 substantially independent of first crampon 52. In at least one additional embodiment, at least one of first and second crampons 52 and 54 may also be movable laterally relative to the frame assembly of exemplary snowshoe 10 (i.e., first and second rails 20 and 25). For example, as illustrated in FIGS. 14A and 14B, first crampon 52 (and first binding portion 60 coupled thereto) may be configured to slide laterally along a portion of pivot rod 98 substantially independent of second crampon 54 (and second binding portion 65 coupled thereto). For example, first crampon 52 (and first binding portion 60 coupled thereto) may slide laterally along pivot rod 98 from a first position (illustrated in FIGS. 3-4) to a second position (illustrated in FIGS. 14A-14B). Similarly, second crampon 54 (and second binding portion 65 coupled thereto) may be configured to slide laterally along a portion of pivot rod 98 substantially independent of first crampon 52 (and first binding portion 60 coupled thereto). Additionally or alternatively, only one of crampons 52 and 54 may be movable laterally relative to the frame assembly of exemplary snowshoe 10. For example, only first crampon 52 may be movable laterally relative to a stationary second crampon 54. Similarly, only second crampon 54 may be movable laterally relative to a stationary first crampon 52.

In at least one embodiment, the width of binding assembly 50 may be adjusted by sliding first crampon 52 and/or second crampon 54 laterally along pivot rod 98. For example, the width of binding assembly 50 may be increased by laterally sliding first crampon 52 (and first binding portion 60 coupled thereto) along pivot rod 98 from a first position (illustrated in FIGS. 3-4) to a second position (illustrated in FIGS. 14A-14B). Accordingly, binding assembly 90 may be adapted to accommodate footwears of varying widths simply by sliding first crampon 52 (and first binding portion 60 coupled thereto) and/or second crampon 54 (and second binding portion 65 coupled thereto) laterally along pivot rod 98. The exemplary embodiment illustrated in FIGS. 14A-14B may also allow a wearer of snowshoe 10 to position binding assembly 90 closer to the medial side of the frame assembly (i.e., proximate second rail 25), which may enable the wearer of snowshoe 10 to position his/her feet closer together, potentially resulting in a more natural walking experience.

The preceding description has been provided to enable others skilled in the art to best utilize the invention in various embodiments and aspects and with various modifications as are suited to the particular use contemplated. This exemplary description is not intended to be exhaustive or to limit the invention to any precise form disclosed. Many modifications and variations in the form and details are possible without departing from the spirit and scope of the invention. In addition, for ease of use, the words "including" and "having," as used in the specification and claims, are interchangeable with and have the same meaning as the word "comprising." It is intended that the scope of the invention be defined by the following claims.

What is claimed is:

1. A snowshoe apparatus, comprising:

a frame assembly;

a pivot assembly pivotally attached to the frame assembly and pivotable about a first pivot axis; and a binding assembly pivotally attached to the pivot assembly and pivotable about a second pivot axis that is laterally spaced from the first pivot axis;

wherein the pivot assembly pivots relative to the frame assembly and the binding assembly pivots about at least a portion of the pivot assembly.

2. The snowshoe of claim 1, wherein the pivot assembly comprises a first pivot arm pivotally attached to the frame assembly, a second pivot arm pivotally attached to the frame assembly, and a pivot rod coupling the first pivot arm to the second pivot arm.

3. The snowshoe of claim 2, wherein the pivot rod comprises a rigid material.

4. The snowshoe of claim 1, wherein the binding assembly comprises:

a first crampon and a first binding portion pivotally attached to the pivot assembly; and a second crampon and a second binding portion pivotally attached to the pivot assembly;

wherein the first crampon and the first binding portion pivot about the pivot assembly substantially independent of the second crampon and the second binding portion.

5. The snowshoe of claim 4, wherein at least one of the first crampon and the second crampon is laterally movable relative to the frame assembly.

6. The snowshoe of claim 4, wherein at least one of the first crampon and the second crampon is laterally movable relative to the frame assembly.

7. The snowshoe of claim 1, wherein the frame assembly comprises:

a first rail having a first end and a second end;

a second rail having a first end and a second end;

a first connecting structure coupling the first end of the first rail to the first end of the second rail, the first connecting structure comprising a flexible material; and a second connecting structure coupling the second end of the first rail to the second end of the second rail, the second connecting structure comprising a flexible material.

8. The snowshoe of claim 7, wherein an outer diameter of the first rail differs from an outer diameter of the second rail.

9. The snowshoe according to claim 1, further comprising a heel support assembly coupled to the frame assembly, the heel support assembly comprising:

a top surface;

a bottom surface; and at least one flexible, resilient material;

wherein at least a portion of the bottom surface of the heel support assembly is substantially concave in shape.

10. The snowshoe of claim 9, further comprising at least one traction structure affixed to at least a portion of the heel support assembly.

11. The snowshoe of claim 1, further comprising:

a deck affixed to at least a portion of the frame assembly;

a first semi-rigid deck reinforcement member coupling the deck to a front portion of the frame assembly; and a second semi-rigid deck reinforcement member coupling the deck to a rear portion of the frame assembly.

12. The snowshoe of claim 1, wherein the binding assembly comprises:

a medial binding portion having at least one receiving structure;

a lateral binding portion;

a heel binding portion having a first end attached to the lateral binding portion and a second end disposed within, and movable relative to, the receiving structure of the medial binding portion;

a first fastening structure provided on the lateral binding portion; and a strap having a first end attached to the medial binding portion and a second end threaded through the fastening structure and attached to the second end of the heel binding portion.

13. The snowshoe of claim 12, further comprising:

a second fastening structure provided on the lateral binding portion; and a handle portion provided on the strap and disposed between the first fastening structure and the second fastening structure.

14. A snowshoe, comprising:

a frame assembly;

a first crampon pivotally attached to the frame assembly; and a second crampon pivotally attached to the frame assembly;

wherein the first crampon pivots relative to the frame assembly substantially independent of the second crampon, and the first and second crampons pivot relative to the frame assembly about the same pivot axis but laterally spaced from each other.

15. The snowshoe of claim 14, further comprising:

a first pivot arm pivotally attached to the frame assembly;

a second pivot arm pivotally attached to the frame assembly; and a pivot rod coupling the first pivot arm to the second pivot arm;

wherein the first crampon and the second crampon are pivotally attached to the pivot rod.

16. The snowshoe of claim 14, wherein at least one of the first crampon and the second crampon is laterally movable relative to the frame assembly.

17. The snowshoe of claim 14, wherein the binding assembly comprises:

a first binding portion attached to the first crampon; and a second binding portion attached to the second crampon;

wherein the first crampon and the first binding portion pivot relative to the frame assembly substantially independent of the second crampon and the second binding portion.

18. A snowshoe apparatus, comprising:

a frame assembly; and a binding assembly coupled to the frame assembly, the binding assembly comprising:

a medial binding portion having at least one receiving structure;

a lateral binding portion;

a heel binding portion having a first end attached to the lateral binding portion and a second end disposed within, and movable relative to, the receiving structure of the medial binding portion;

a first fastening structure provided on the lateral binding portion; and a strap having a first end attached to the medial binding portion and a second end threaded through the fastening structure on the lateral binding portion and attached to the second end of the heel binding portion;

wherein the binding assembly rotates relative to the frame assembly about two laterally spaced apart pivot axes.

19. The snowshoe of claim 18, wherein the binding assembly further comprises:

a second fastening structure provided on the lateral binding portion; and a handle portion provided on the strap and disposed between the first fastening structure and the second fastening structure.

20. The snowshoe of claim 18, wherein the heel portion and the lateral portion are integrally formed in a one-piece construction.

21. A method of assembling a snowshoe apparatus, the method comprising:

providing a frame assembly;

pivotally attaching a pivot assembly to the frame assembly; and pivotally attaching a binding assembly to the pivot assembly;

wherein the pivot assembly pivots relative to the frame assembly about a first pivot axis, and the binding assembly pivots about at least a portion of the pivot assembly about a second pivot axis that is laterally spaced apart from the first pivot axis.

22. A snowshoe apparatus, comprising:

a frame assembly;

a pivot assembly pivotally attached to the frame assembly; and a binding assembly pivotally attached to the pivot assembly, the binding assembly comprising:

a first crampon and a first binding portion pivotally attached to the pivot assembly; and a second crampon and a second binding portion pivotally attached to the pivot assembly;

wherein the pivot assembly pivots relative to the frame assembly and the binding assembly pivots about at least a portion of the pivot assembly;

wherein the first crampon and the first binding portion pivot about the pivot assembly substantially independent of the second crampon and the second binding portion.

23. A snowshoe, comprising:

a frame assembly;

a first crampon pivotally attached to the frame assembly; and a second crampon pivotally attached to the frame assembly;

a first pivot arm pivotally attached to the frame assembly;

a second pivot arm pivotally attached to the frame assembly; and a pivot rod coupling the first pivot arm to the second pivot arm;

wherein the first crampon pivots relative to the frame assembly substantially independent of the second crampon;

wherein the first crampon and the second crampon are pivotally attached to the pivot rod.

24. The snowshoe of claim 23, wherein at least one of the first crampon and the second crampon is laterally movable relative to the frame assembly.

25. A snowshoe, comprising:

a frame assembly;

a first crampon pivotally attached to the frame assembly; and a second crampon pivotally attached to the frame assembly;

a binding assembly comprising:

a first binding portion attached to the first crampon; and a second binding portion attached to the second crampon;

wherein the first crampon pivots relative to the frame assembly substantially independent of the second crampon;

wherein the first crampon and the first binding portion pivot relative to the frame assembly substantially independent of the second crampon and the second binding portion.

26. The snowshoe of claim 25, wherein at least one of the first crampon and the second crampon is laterally movable relative to the frame assembly.

* * * * *